US011122893B2

(12) United States Patent
Chen

(10) Patent No.: US 11,122,893 B2
(45) Date of Patent: Sep. 21, 2021

(54) SELF-OPENING DEVICE

(71) Applicant: SLIDE MEI YAO INTERNATIONAL CO., LTD., New Taipei (TW)

(72) Inventor: Tsung-Yao Chen, New Taipei (TW)

(73) Assignee: SLIDE MEI YAO INTERNATIONAL CO., LTD., New Taipei (TW)

( * ) Notice: Subject to any disclaimer, the term of this patent is extended or adjusted under 35 U.S.C. 154(b) by 58 days.

(21) Appl. No.: 16/459,000

(22) Filed: Jul. 1, 2019

(65) Prior Publication Data

US 2021/0000255 A1 Jan. 7, 2021

(51) Int. Cl.
*A47B 88/463* (2017.01)
*A47B 88/477* (2017.01)

(52) U.S. Cl.
CPC ..... *A47B 88/463* (2017.01); *A47B 88/477* (2017.01)

(58) Field of Classification Search
CPC ..... A47B 88/463; A47B 88/477; A47B 88/47; A47B 88/473; A47B 88/57; E05B 63/22; E05B 65/46; E05F 1/16; E05Y 2201/426; E05Y 2900/20
See application file for complete search history.

(56) References Cited

U.S. PATENT DOCUMENTS 9,642,461 B2 * 5/2017 Goetz ..... A47B 88/57
2010/0026152 A1 * 2/2010 Huang ..... A47B 88/463 312/319.1
2013/0287324 A1 * 10/2013 Nuckolls ..... A47B 88/463 384/18
2015/0091424 A1 * 4/2015 Nuckolls ..... A47B 88/467 312/319.1
2016/0227927 A1 * 8/2016 Goetz ..... A47B 88/407
2017/0051813 A1 * 2/2017 Karu ..... F16H 21/44
2018/0125235 A1 * 5/2018 Wohlgenannt ..... A47B 88/467

FOREIGN PATENT DOCUMENTS

CN 101374438 B 2/2011
EP 3295828 A1 3/2018
WO 2013073489 A1 5/2013

OTHER PUBLICATIONS

Search Report issued to European counterpart application No. 19183480.3 by the EPO dated Sep. 30, 2019.

* cited by examiner

*Primary Examiner* — Hiwot E Tefera
(74) *Attorney, Agent, or Firm* — Muncy, Geissler, Olds & Lowe, P.C.

(57) ABSTRACT

A self-opening device includes a motion guide mechanism and a force-creating mechanism. The motion guide mechanism includes a movable slide cover, a base seat and a latch member. The slide cover includes a latch groove unit. The latch groove unit includes a positioning portion. The latch member has a latch pin portion. The force-creating mechanism is able to store elastic energy for providing a restoring force that is oriented in an energy-release direction. The slide cover is associated with the force-creating mechanism. A portion of movement of the slide cover drawn by the force-creating mechanism is able to be damped.

4 Claims, 26 Drawing Sheets

SELF-OPENING DEVICE

FIELD

The disclosure relates to a self-opening device, and more particularly to a push-to-open device.

BACKGROUND

An article of furniture may include a housing and a drawer. The drawer is operable to be opened (i.e., being drawn out from the housing) or closed (i.e., being pushed into the housing) relative to the housing. Two conventional self-opening devices may be respectively provided at two opposite lateral sides of the drawer. Each of the conventional self-opening devices functions such that the drawer can be depressed to be automatically opened. However, each of the conventional self-opening devices may have a locking mechanism that functions such that the drawer cannot be opened unless the drawer is depressed. For example, referring to FIG. 1, a conventional self-opening device disclosed in Chinese Patent Publication No. 101374438 B includes a movable member 14 that is co-movably connected to a drawer (not shown), a push member 19 that is resiliently biased, a pin member 18 that is connected to the push member 19, and a locking member 10 that is pivotally connected to the push member 19. When the push member 19 is pushed against the biasing action applied thereon such that the pin member 18 engages a positioning groove (i.e., the conventional self-opening devices is in a locked state), the locking member 10 cooperates with the push member 19 to sandwich the movable member 14 therebetween, so that the movable member 14 is prevented from moving forwardly by the locking member 10 (i.e., the drawer is prevented from being opened) unless the drawer is depressed. As such, when the drawer is forced to open without being depressed, the components of the conventional self-opening devices may fracture. Moreover, if a force applied to depress the drawer is uneven, one of the conventional self-opening devices may be depressed to provide a force to open the drawer while the other one of the conventional self-opening devices is maintained in a locked state. As a result, the drawer would not be able to be opened despite following depressions of the drawer.

SUMMARY

Therefore, an object of the disclosure is to provide a self-opening device that can alleviate at least one of the drawbacks of the prior art.

According to the disclosure, the self-opening device is for use in a slide rail mechanism. The slide rail mechanism includes a fixed rail unit, and a movable rail unit that is movable along the fixed rail unit in an energy-storing direction and an energy-release direction different from the energy-storing direction. The self-opening device includes a motion guide mechanism and a force-creating mechanism. The motion guide mechanism includes a movable slide cover, a base seat and a latch member. The slide cover includes a latch groove unit. The latch groove unit includes a positioning portion. The latch member has a latch pin portion. The force-creating mechanism is able to store elastic energy for providing a restoring force that is oriented in the energy-release direction. The slide cover is associated with the force-creating mechanism. A portion of movement of the slide cover drawn by the force-creating mechanism is able to be damped.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
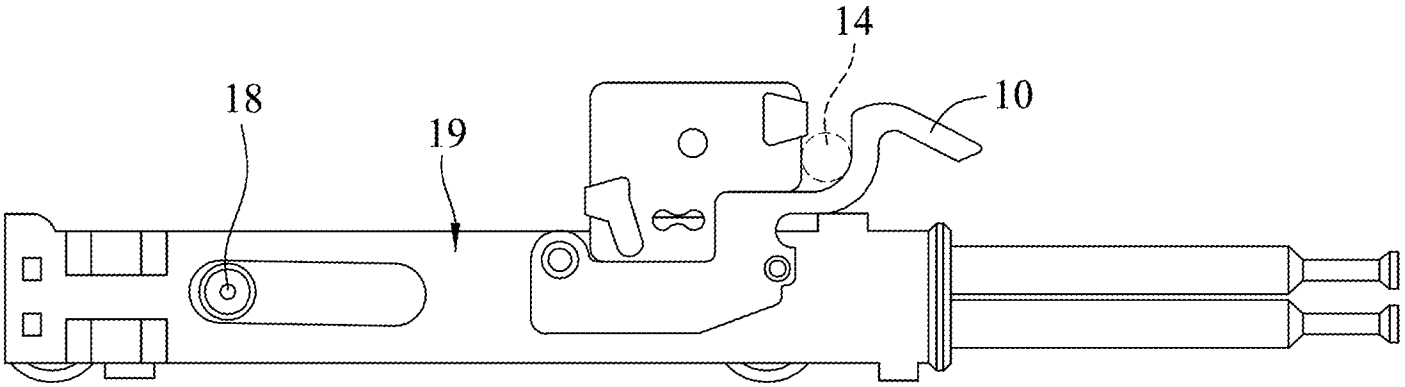
FIG.1 PRIOR ART
FIG. 1 is a top view illustrating a conventional self-opening device disclosed in Chinese Patent Publication No. 101374438 B.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
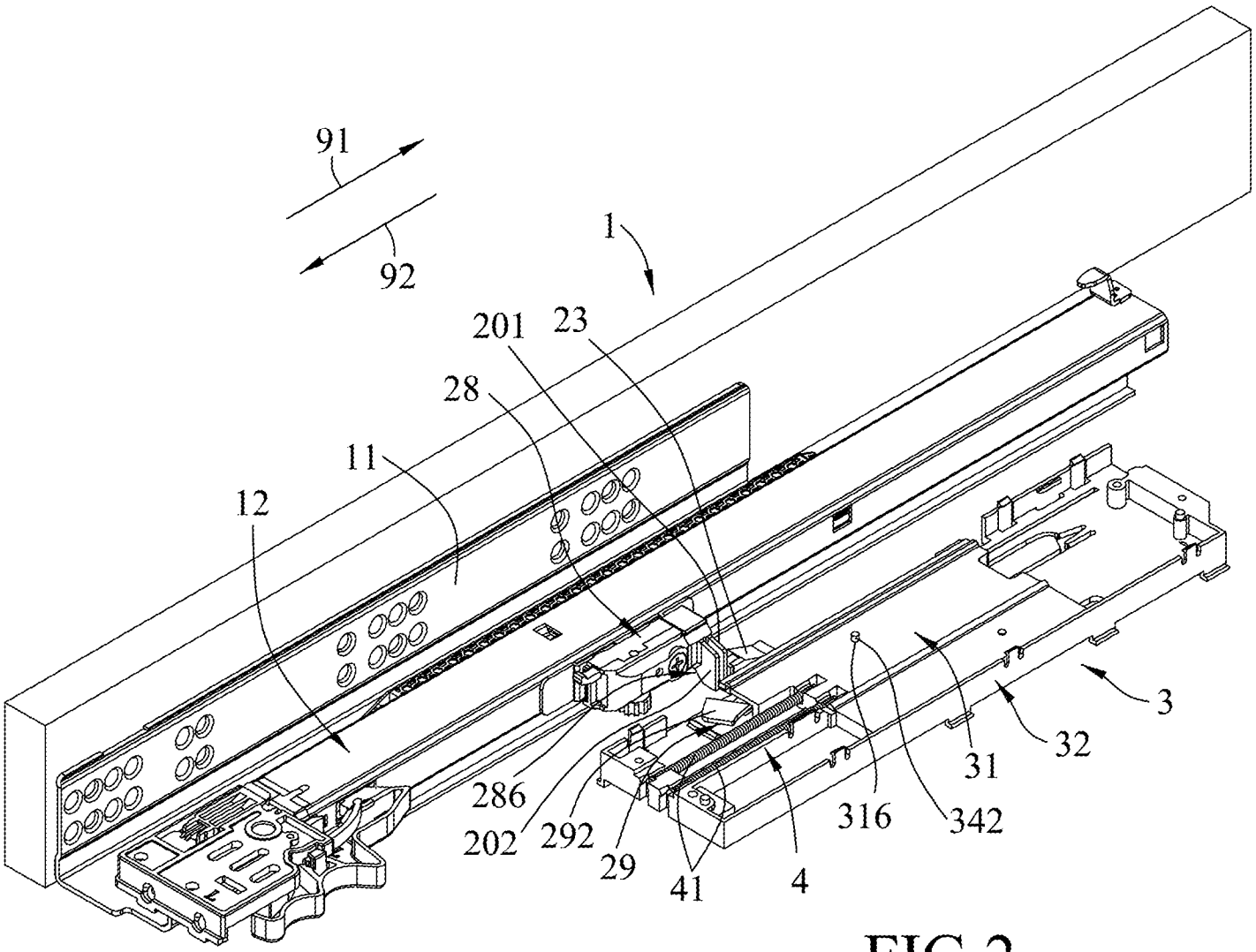
FIG. 2 is an assembled perspective view illustrating a first embodiment of the self-opening device according to the disclosure.
Figure 3:
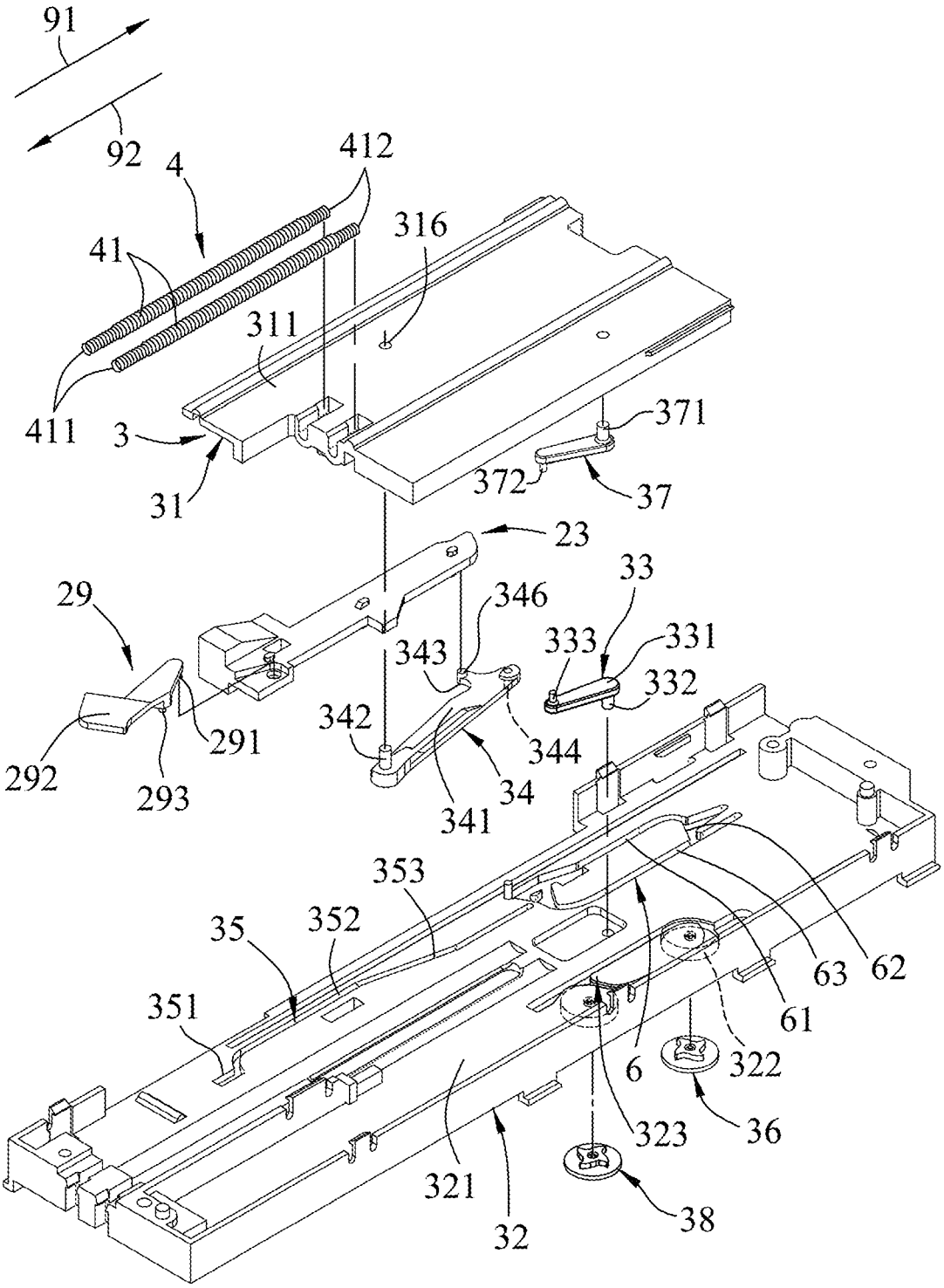
FIG. 3 is an exploded perspective view illustrating the first embodiment.
Figure 4:
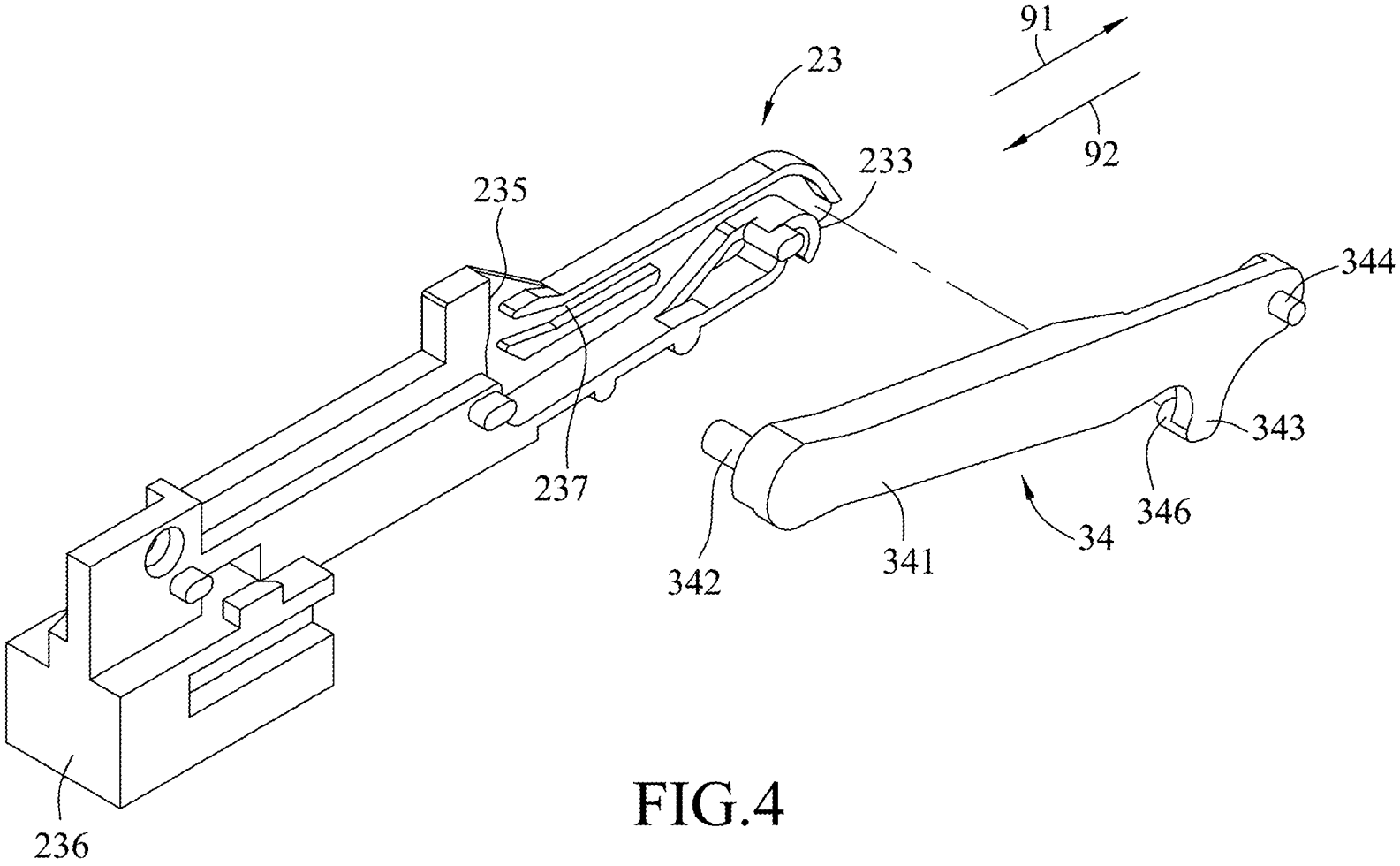
FIG. 4 is a perspective view illustrating a push member and a driven member of the first embodiment.

Referring to FIGS. 2 to 4, the first embodiment of the self-opening device according to the disclosure is for use in an article of furniture, such as a cabinet or a closet. The article of furniture includes a housing (not shown), a drawer (not shown) that is operable to be opened (i.e., being drawn out from the housing) or closed (i.e., being pushed into the housing) relative to the housing, and a slide rail mechanism 1. The slide rail mechanism 1 includes a fixed rail unit 11 that is fixedly connected to the housing, and a movable rail unit 12 that is co-movably connected to the drawer. The movable rail unit 12 is reciprocally movable along the fixed rail unit 11 in an energy-storing direction 91 and an energy-release direction 92 that is different from the energy-storing direction 91. In this embodiment, the energy-storing direction 91 is the direction in which the drawer is pushed into the housing, and is oriented toward a rear side of the housing. The energy-release direction 92 is parallel to and opposite to the energy-storing direction 91, is the direction in which the drawer is drawn out from the housing, and is oriented toward a front side of the housing. This embodiment is exemplified to be used in a drawer, but may be used in any article that is movable along a rail. The first embodiment of the self-opening device includes a push mechanism 2, a motion guide mechanism 3 and a force-creating mechanism 4.

The push mechanism 2 includes a push member 23, an urge unit 28 that is co-movably mounted to the movable rail unit 12, and an auxiliary push member 29 that is pivotally connected to the push member 23. With particular reference to FIG. 4, the push member 23 has a first push surface 233, a guide groove 237 that is formed in a bottom surface of the push member 23, a second push surface 235 that is located at one side of the guide groove 237, and an urge surface 236. In some embodiment, the first push surface 233 and the second push surface 235 are respectively located at two opposite sides of the guide groove 237. The guide groove 237 has an inlet distal from the second push surface 235. The urge unit 28 is connected to the drawer via the movable rail unit 12, and is for pushing the urge surface 236 of the push member 23 to move the push member 23 in the energy-storing direction 91. The auxiliary push member 29 has an auxiliary connecting portion 291 that is pivotally connected to the push member 23, an auxiliary urge portion 292, and an auxiliary guide pin 293 that is located between the auxiliary connecting portion 291 and the auxiliary urge portion 292 and that extends downwardly. The auxiliary push member 29 is movable along with the push member 23, and is pivotable relative to the push member 23.

Figure 5:
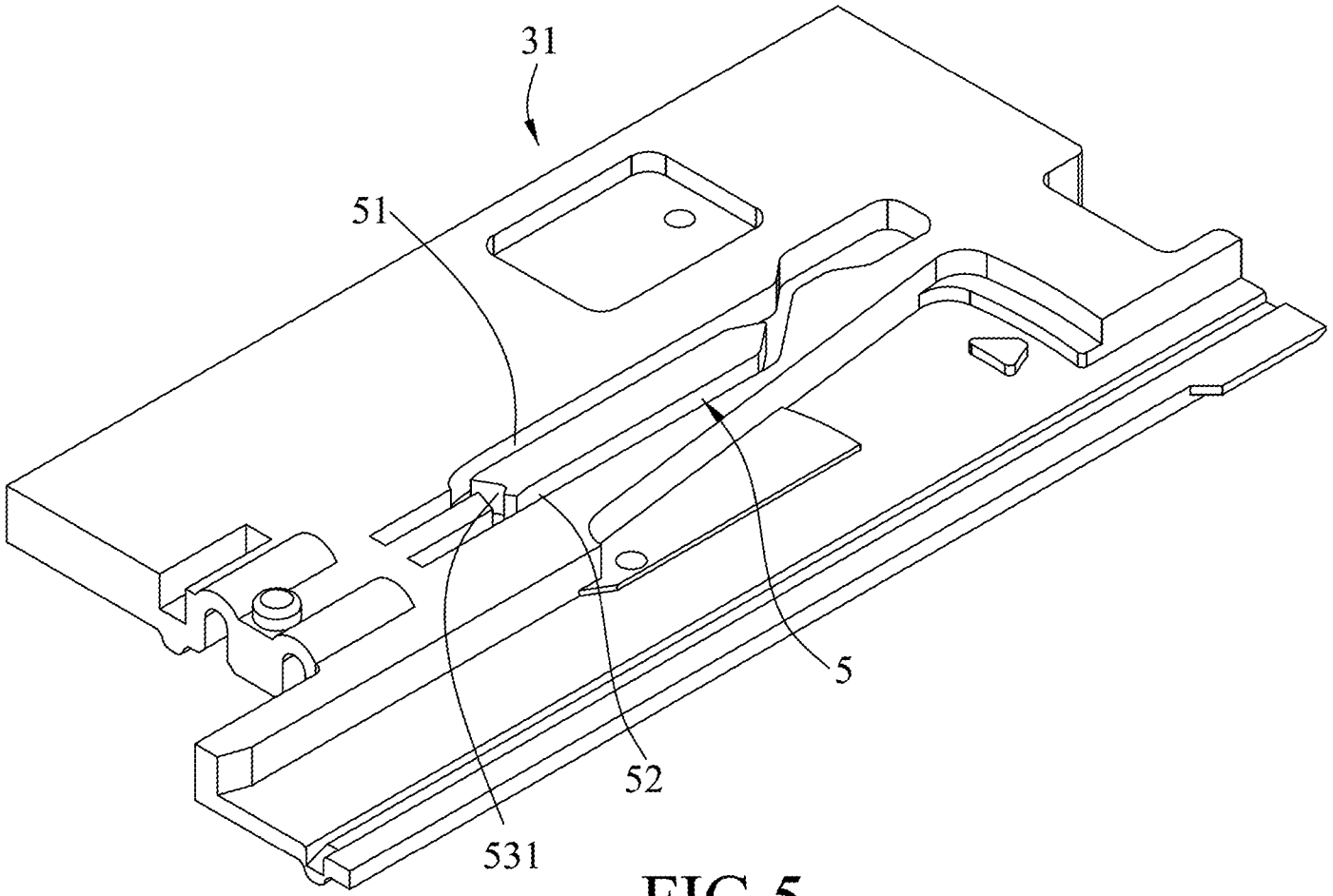
FIG. 5 is a perspective view illustrating a slide cover of the first embodiment.

Referring to FIGS. 2, 3 and 5, the motion guide mechanism 3 includes a movable slide cover 31, a base seat 32 that is fixedly connected to the fixed rail unit 11, a latch member 33 that is pivoted to the base seat 32, and a driven member 34 that is pivoted to the slide cover 31. The slide cover 31 is slidably disposed on the base seat 32, and includes a top wall 311 that has a driven connecting portion 316, and a latch groove unit 5 that is formed in a bottom surface of the top wall 311. In some embodiment, the push member 23 is slidably mounted to the slide cover 31.

Figure 6:
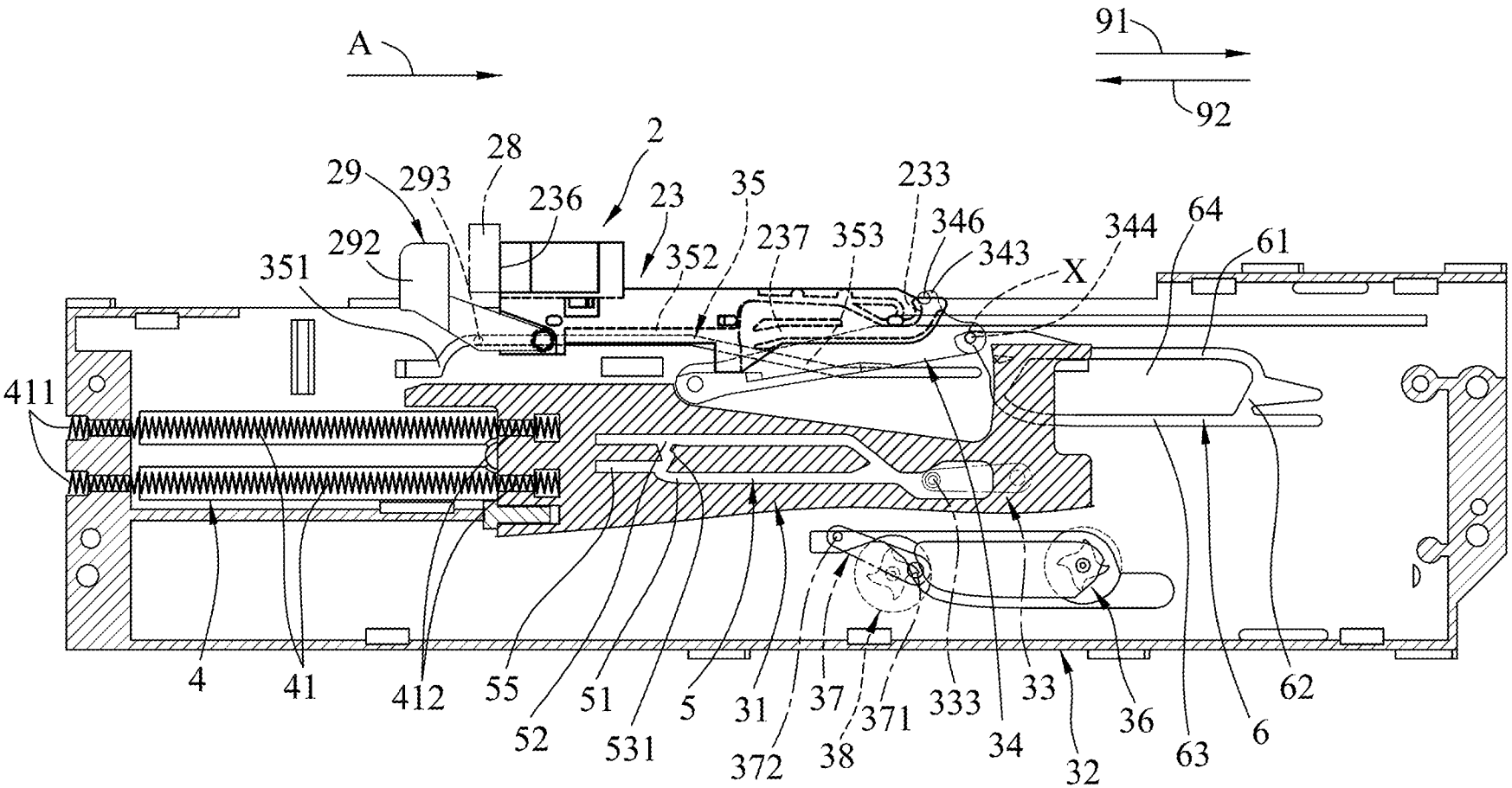
FIG. 6 is a sectional view illustrating the slide cover at an energy-storing initial position.
Figure 7:
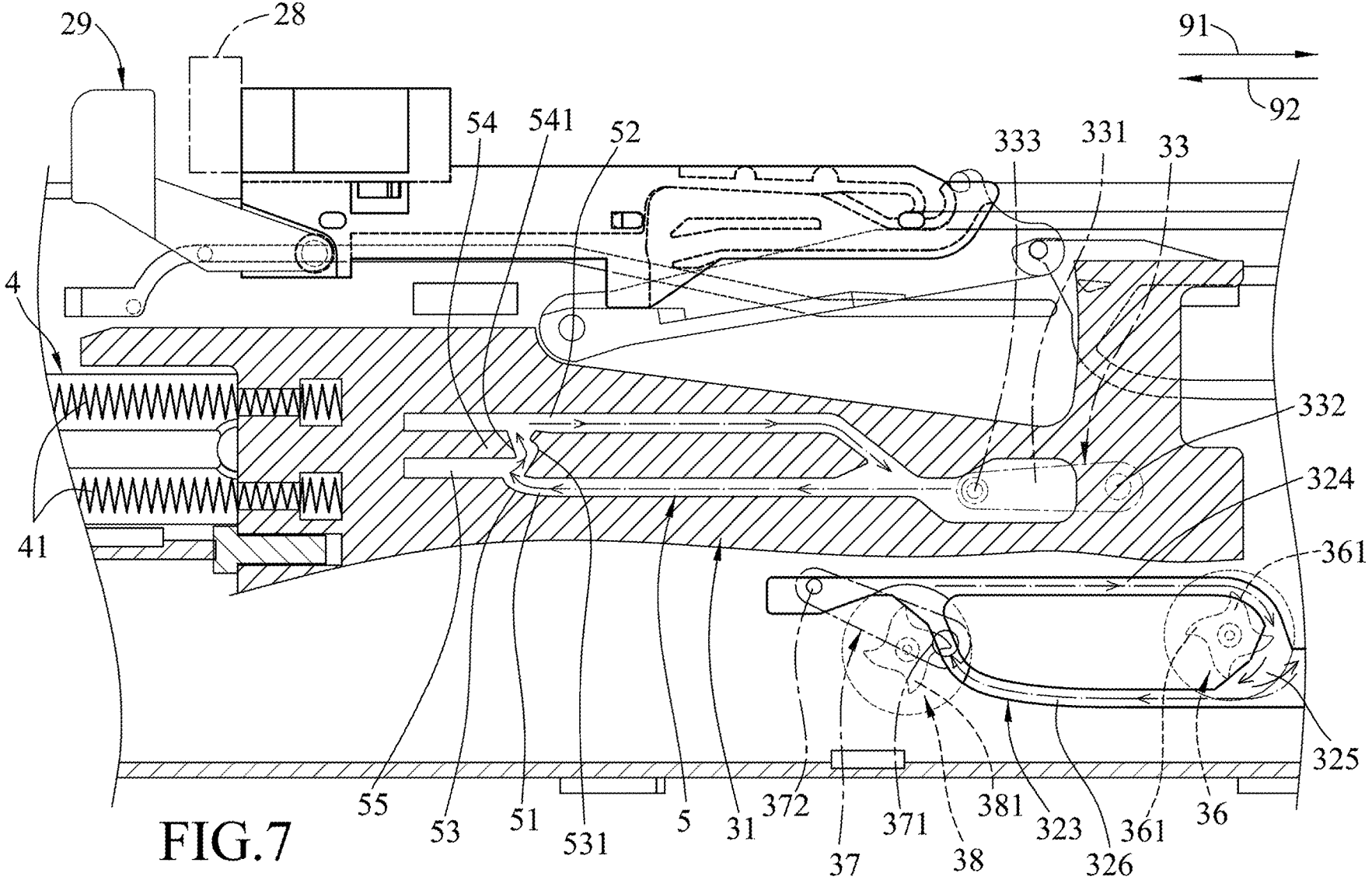
FIG. 7 is a enlarged fragmentary sectional view illustrating a latch pin portion of a latch member at an energy-storing initial point of a latch groove unit.

Referring to FIGS. 5 to 7, the latch groove unit includes an energy-storing groove 51, an energy-release groove 52, a positioning portion 531 that is disposed between the energy-storing groove 51 and the energy-release groove 52, a first transition block 53 (see FIG. 7), a second transition block 54 (see FIG. 7) that corresponds in position to the positioning portion 531, and a transition groove 55 that is located at one side of the second transition block 54 and that is in spatial communication with the positioning portion 531. The second transition block 54 has a second transition surface 541 that faces the positioning portion 531 and that is inclined forwardly and toward the energy-release groove 52.

Figure 8:
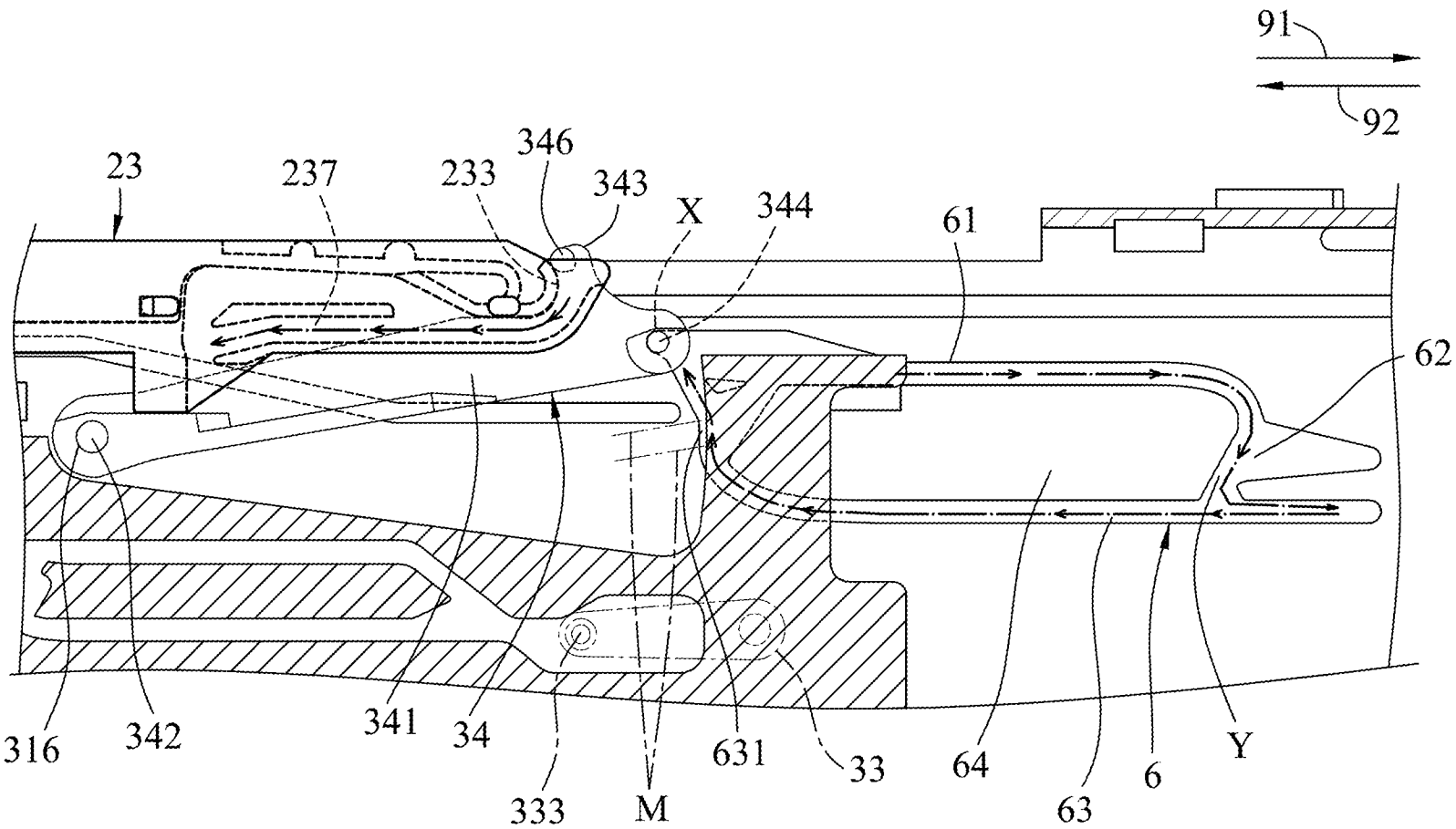
FIG. 8 is another enlarged fragmentary sectional view illustrating a first driven pin portion of a driven member at an energy-storing initial point of a driven groove unit.

Referring to FIGS. 3, 6 and 8, the base seat 32 has a bottom wall 321, a driven groove unit 6 that is formed in a top surface of the bottom wall 321, and an auxiliary groove 35 that is formed in the top surface of the bottom wall 321. The driven groove unit 6 includes an energy-storing groove 61 that extends in the energy-storing direction 91, a bent groove 62 that is located at an end of the energy-storing groove 61, an energy-release groove 63, and a block member 64 that is surrounded by the energy-storing groove 61, the bent groove 62 and the energy-release groove 63. The energy-release groove 63 has a first portion that extends from the bent groove 62 in the energy-release direction 92, and a second portion that is bent from the first portion and that extends to the other end of the energy-storing groove 61 distal from the bent groove 62. With particular reference to FIG. 8, the second portion of the energy-release groove 63 has a stagnation region 631 that is substantially defined between two imaginary lines (M) in FIG. 8. The driven groove unit 6 defines an energy-storing initial point (X) at the energy-storing groove 61, and an energy-storing end point (Y) at the bent groove 62.

Figure 9:
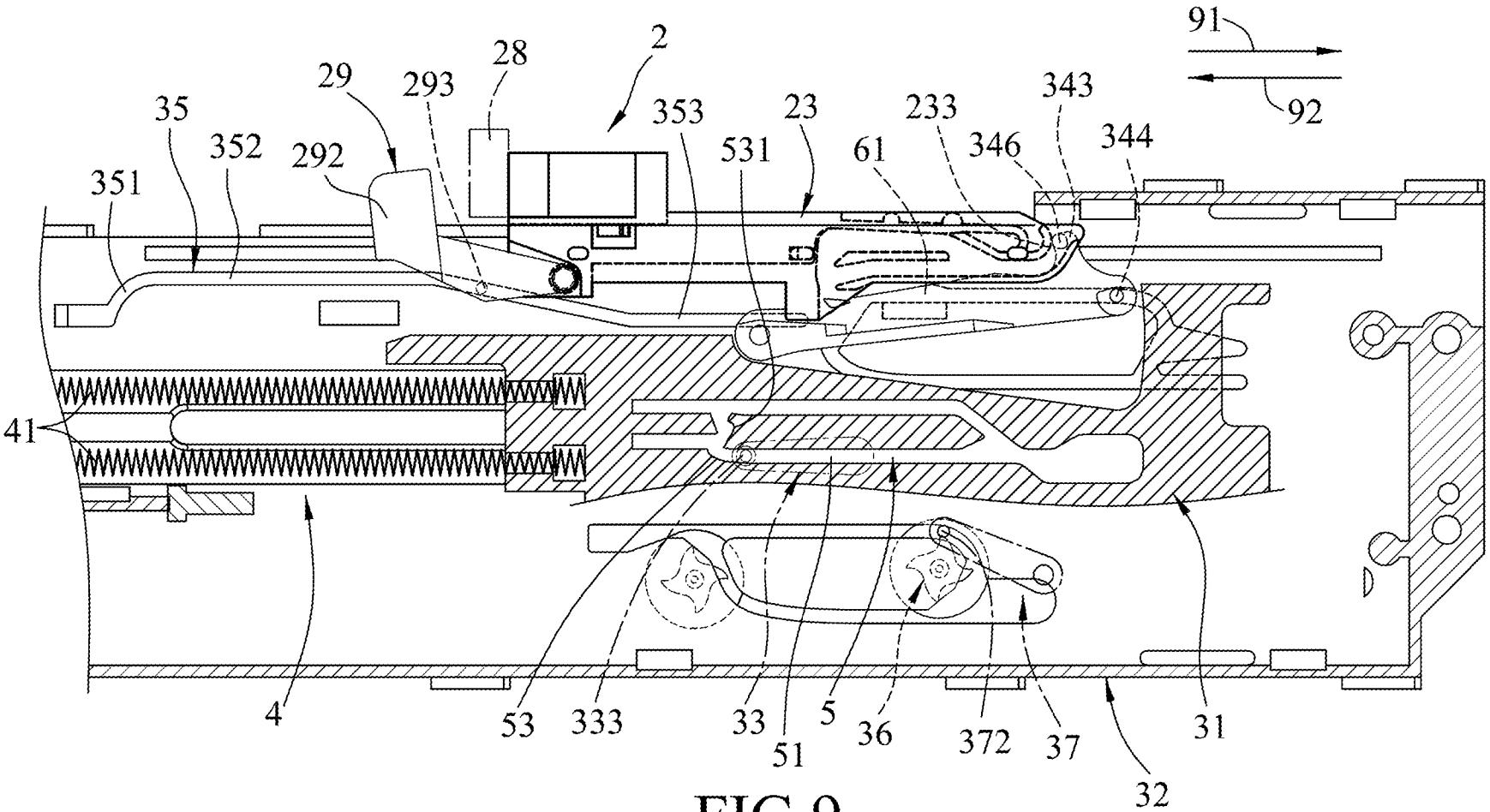
FIG. 9 is a fragmentary sectional view illustrating the slide cover being moved in an energy-storing direction.
Figure 10:
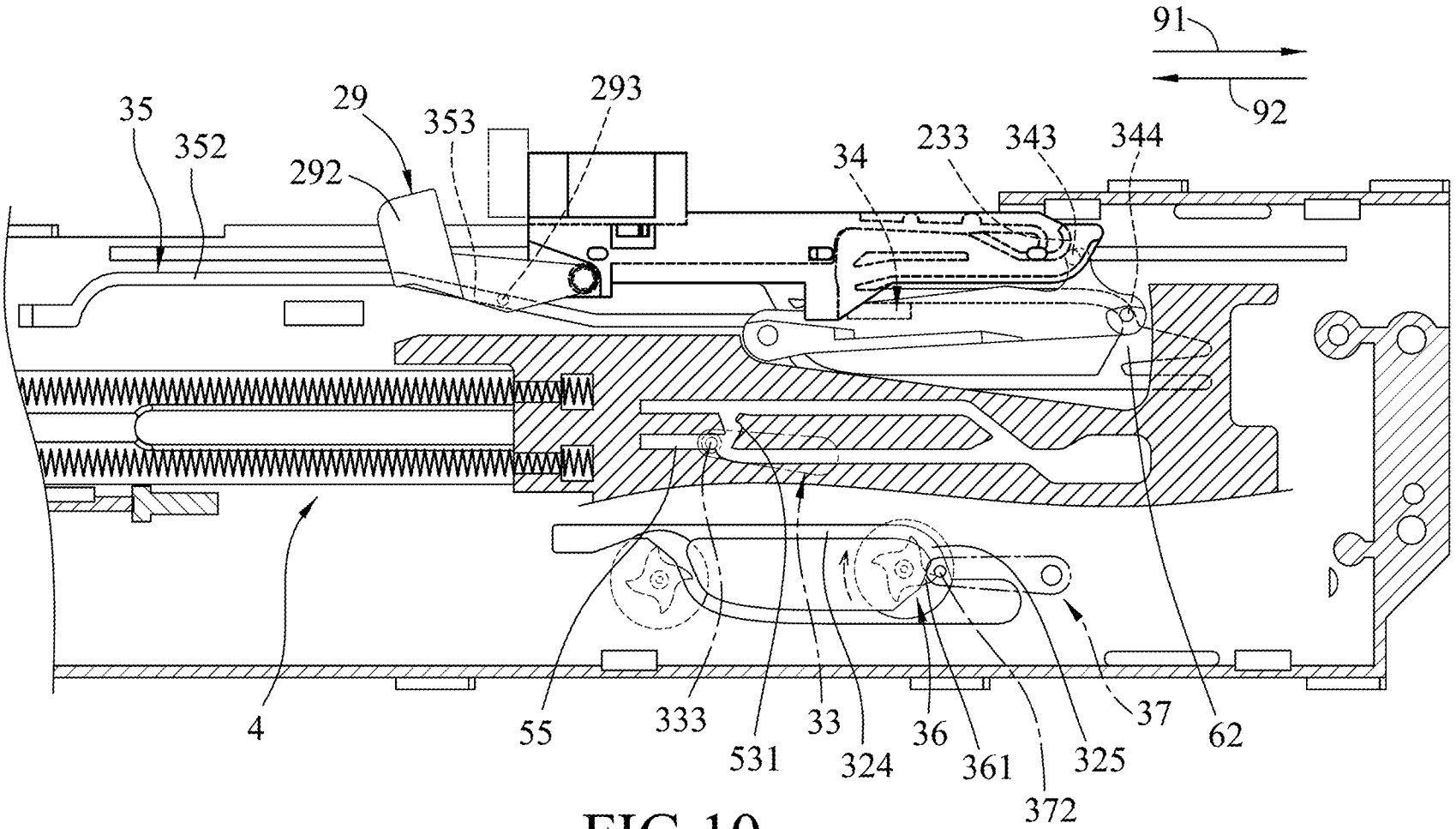
FIG. 10 is a fragmentary sectional view illustrating the first driven pin portion of the driven member moving into a bent groove of the driven groove unit.
Figure 11:
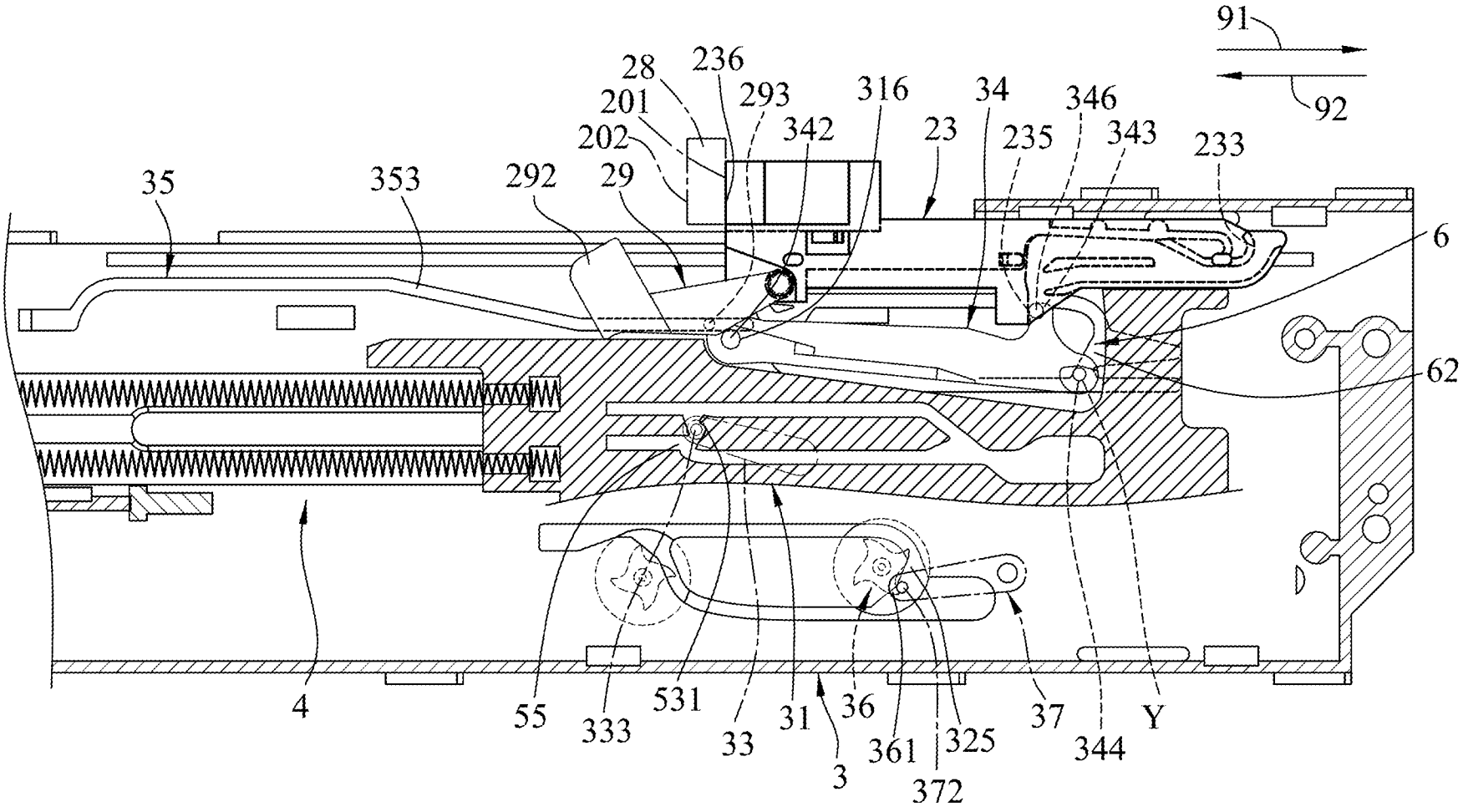
FIG. 11 is a fragmentary sectional view illustrating the first driven pin portion of the driven member moving to an energy-storing end point of the driven groove unit, and the slide cover being in an energy-stored position.
Figure 16:
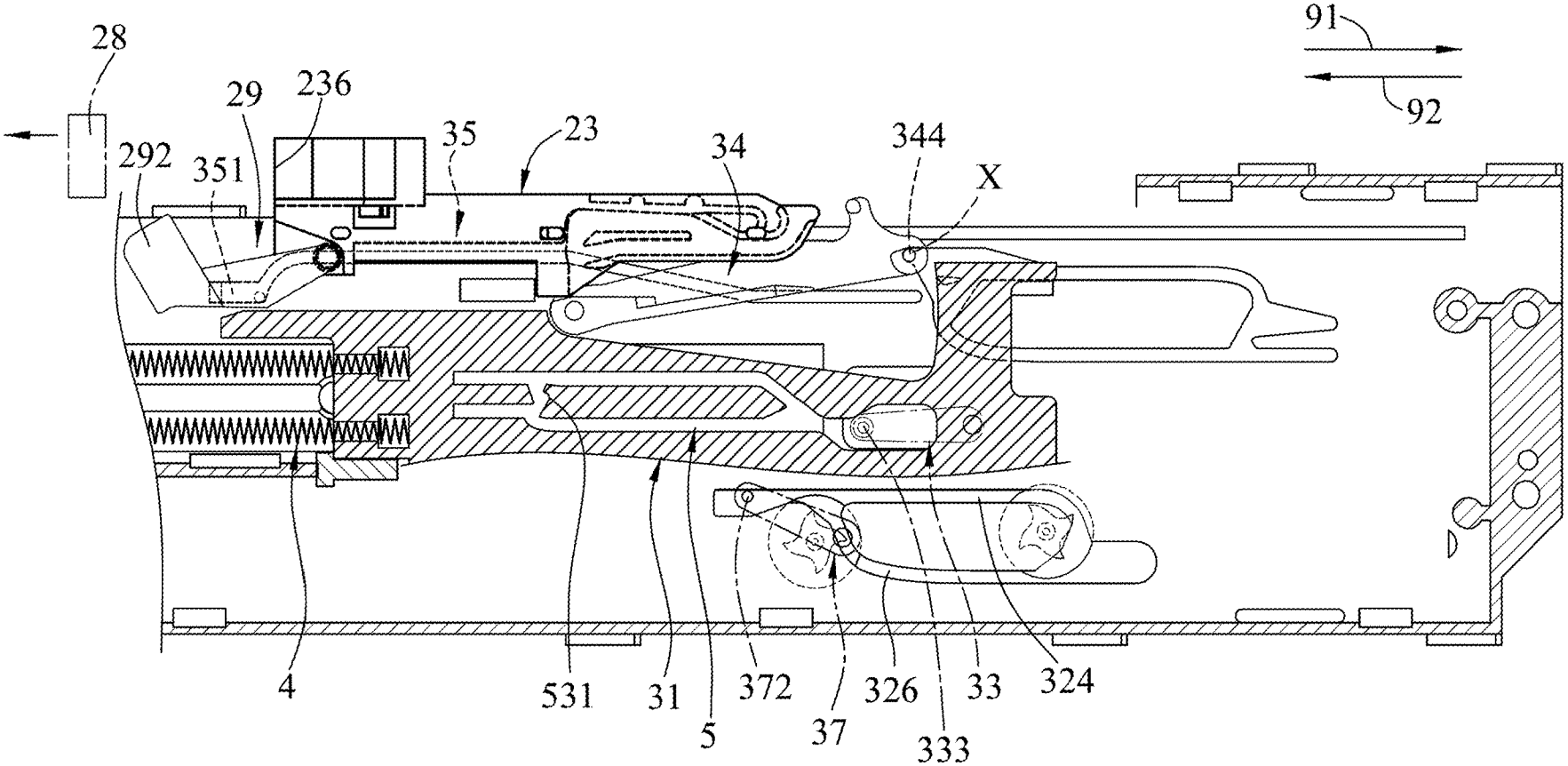
FIG. 16 is a fragmentary sectional view illustrating the first driven pin portion of the driven member moving back to the energy-storing initial point of the driven groove unit.

The auxiliary groove 35 has a first groove section 351, a second groove section 352 and a third groove section 353. The second groove section 352 is located between the first groove section 351 and the third groove section 353, and is configured as a straight groove that extends in the energy-storing direction 91. The third groove section 353 has an inclined straight portion that is oblique to the second groove section 352, and a parallel straight portion that is parallel to the second groove section 352. The auxiliary groove 35 permits the auxiliary guide pin 293 of the auxiliary push member 29 to move therealong, so as to guide movement of the auxiliary push member 29 relative to the push member 23. Referring to FIGS. 9 to 11, the auxiliary guide pin 293 of the auxiliary push member 29 is movable along the auxiliary groove 35. During an energy-storing process, the auxiliary guide pin 293 moves from the first groove section 351 to the third groove section 353 via the second groove section 352. During an energy-release process, the auxiliary guide pin 293 moves from the third groove section 353 to the first groove section 351 via the second groove section 352. FIG. 6 illustrates the auxiliary guide pin 293 being located at the second groove section 352. FIG. 16 illustrates the auxiliary guide pin 293 being located at the first groove section 351 so that the auxiliary urge portion 292 of the auxiliary push member 29 is retracted into the slide cover 31. When the auxiliary guide pin 293 moves from the first groove section 351 to the second groove section 352 (i.e., the self-opening device is switched from the state in FIG. 16 to the state in FIG. 6), the auxiliary urge portion 292 of the auxiliary push member 29 moves out of the slide cover 31. The abovementioned "retracted into the slide cover 31" may mean that the auxiliary urge portion 292 is wholly or substantially covered by the slide cover 31, as long as the auxiliary urge portion 292 of the auxiliary push member 29 and the urge unit 28 do not interfere with each other. In other words, "retracted into the slide cover 31" means that the auxiliary urge portion 292 of the auxiliary push member 29 is removed from the path of movement of the urge unit 28. When the auxiliary guide pin 293 moves from the second groove section 352 to the parallel straight portion of the third groove section 353 via the inclined straight portion of the third groove section 353 (i.e., the self-opening device is switched from the state in FIG. 6 to the state in FIG. 9 and further to the state in FIG. 11), the auxiliary urge portion 292 of the auxiliary push member 29 is retracted into the slide cover 31 again.

Referring to FIGS. 3, 4 and 6, the latch member 33 is pivotally mounted to the base seat 32, and has a latch body 331 that is located above the base seat 32, a latch pivoted portion 332 that protrudes from a bottom surface of the latch body 331 and that is pivoted to the base seat 32, and a latch pin portion 333 that protrudes upwardly from the latch body 331 and that is movable within the latch groove unit 5.

The driven member 34 is pivotally mounted to the slide cover 31, and has a driven body 341 that is located below the slide cover 31, a driven pivoted portion 342 that protrudes upwardly from the driven body 341 and that is pivoted to the driven connecting portion 316 of the top wall 311 of the slide cover 31, a driven projection 343 that projects from the driven body 341 and that is located on the path of movement of the push member 23, and a first driven pin portion 344 that protrudes downwardly from the driven body 341. The driven projection 343 has a second driven pin portion 346 that protrudes upwardly and that is movable within the guide groove 237 of the push member 23. The first driven pin portion 344 is movable along the energy-storing groove 61, the bent groove 62 and the energy-release groove 63 of the driven groove unit 6. The driven member 34 of this embodiment pivots relative to the slide cover 31 about the driven connecting portion 316. The driven member 34 and the latch member 33 are independent components. The first driven pin portion 344 of the driven member 34 and the latch pin portion 333 of the latch member 33 are movable relative to each other.

Referring to FIGS. 3, 6 and 7, the base seat 32 further has an installation slot 322 that is formed in a bottom surface of the bottom wall 321, and a buffer passage unit 323. The buffer passage unit 323 includes a first passage 324 that substantially extends in the energy-storing direction 91, a bent second passage 325 that is in communication with an end of the first passage 324, and a third passage 326 that is in communication with an end of the second passage 325 distal from the first passage 324 and the other end of the first passage 324 distal from the second passage 325. In some embodiment, the third passage 326 has a first portion that extends from the second passage 325 in the energy-release direction 92, and a second portion that is bent from the first portion and extends to the other end of the first passage 324 distal from the second passage 325.

The motion guide mechanism 3 further includes a first buffer member 36 that is mounted to the installation slot 322, a swing arm 37 that is driven to push and rotate the first buffer member 36, and a second buffer member 38 that is located below the bottom wall 321 of the base seat 32 and that is spaced apart from the first buffer member 36. In this embodiment, the first buffer member 36 is configured as a ratchet wheel, and has a plurality of teeth 361. The swing arm 37 is located between the slide cover 31 and the base seat 32, and has a swing pivoted portion 371 that protrudes upwardly and that is pivoted to the slide cover 31, and a swing pin portion 372 that protrudes downwardly and that is movable within the buffer passage unit 323. The swing pin portion 372 sequentially circulates among the first passage 324, the second passage 325 and the third passage 326. The swing arm 37 is movable along with the slide cover 31, and is pivotable relative to the slide cover 31. In this embodiment, the second buffer member 38 is configured as a ratchet wheel, and has a plurality of teeth 381.

Referring to FIGS. 2 and 3, the force-creating mechanism 4 interconnects the base seat 32 and the slide cover 31, and is able to store elastic energy for providing at least one restoring force that is oriented in the energy-release direction 92. In this embodiment, the force-creating mechanism 4 is operable to provide a first-stage restoring force and a second-stage restoring force that are sequentially applied on the slide cover 31 and that are oriented in the energy-release direction 92. The force-creating mechanism 4 includes a plurality of springs 41. Each of the springs 41 is configured as an extension spring, extends in the energy-storing direction 91, and has a first end 411 that is connected to the base seat 32, and a second end 412 that is connected to the slide cover 31.

In use, the drawer, the movable rail unit 12 (see FIG. 2) and the push mechanism 2 is operable to switch between an energy-storing initial state (see FIGS. 6, 7 and 8), and a close state (see FIG. 11). Referring to FIGS. 6, 7 and 8, in the energy-storing initial state, the drawer is opened, the slide cover 31 is at an energy-storing initial position, the latch pin portion 333 of the latch member 33 is at an energy-storing initial point of the energy-storing groove 51 of the latch groove unit 5, the first driven pin portion 344 of the driven member 34 is at the energy-storing initial point (X) of the driven groove unit 6, the second driven pin portion 346 of the driven member 34 is at the inlet of the guide groove 237 of the push member 23, and the swing pin portion 372 of the swing arm 37 is at an initial point of the first passage 324 of the buffer passage unit 323.

Referring to FIGS. 6, 8 and 9, to close the drawer, the drawer is pushed in the energy-storing direction 91 (as shown by the arrow (A) in FIG. 6) so that the movable rail unit 12 (see FIG. 2) and the urge unit 28 are moved in the energy-storing direction 91. The urge unit 28 pushes and moves the push member 23 in the energy-storing direction 91, so that the second driven pin portion 346 of the driven member 34 enters the inlet of the guide groove 237 of the push member 23, and that the first push surface 233 of the push member 23 pushes the driven projection 343 of the driven member 34 to move the driven member 34 in the energy-storing direction 91. The first driven pin portion 344 of the driven member 34 moves along the energy-storing groove 61 of the driven groove unit 6 and moves relative to the latch pin portion 333 of the latch member 33. Since the driven pivoted portion 342 of the driven member 34 is pivoted to the driven connecting portion 316 of the top wall 311 of the slide cover 31, the movement of the driven member 34 in the energy-storing direction 91 drives movement of the slide cover 31 in the energy-storing direction 91. The springs 41 of the force-creating mechanism 4 are stretched to store elastic energy. Since the latch member 33 is pivoted to the base seat 32 and since the patch pin portion 333 of the latch member 33 moves in the energy-storing groove 51 of the latch groove unit 5, during the movement of the slide cover 31 relative to the base seat 32 in the energy-storing direction 91, the patch pin portion 333 of the latch member 33 gradually approaches the first transition block 53 from an end of the energy-storing groove 51 distal from the first transition block 53. Referring to FIG. 10, the latch pin portion 333 of the latch member 33 then moves past the first transition block 53 and enters the transition groove 55. The force-creating mechanism 4 is operated to generate the first-stage restoring force after the abovementioned operation. In addition, the movement of the push member 23 also drives movement of the auxiliary push member 29. In FIGS. 9 and 10, the auxiliary urge portion 292 of the auxiliary push member 29 is located out of the slide cover 31. In the process from FIG. 6 to FIG. 9, the swing arm 37 also moves in the energy-storing direction 91, and the swing pin portion 372 of the swing arm 37 moves along the first passage 324 of the buffer passage unit 323 and gradually approaches the first buffer member 36.

Referring to FIGS. 10 and 11, when the first push surface 233 of the push member 23 pushes the driven projection 343 of the driven member 34 such that the first driven pin portion 344 of the driven member 34 moves into the bent groove 62 of the driven groove unit 6, the first-stage restoring force generated by the force-creating mechanism 4 immediately moves the slide cover 31 relative to the latch member 33 in the energy-release direction 92, so that the latch pin portion 333 of the latch member 33 engages the positioning portion 531 and that the first driven pin portion 344 of the driven member 34 moves along the bent groove 62 to rotate the driven member 34 relative to the slide cover 31 for removing the driven projection 343 from the path of movement of the first push surface 233 of the push member 23. The slide cover 31 is at an energy-stored position after the abovementioned operation. Referring to FIG. 11, after the slide cover 31 is moved to the energy-stored position, the push member 23 is further moved in the energy-storing direction 91 by the urge unit 28 until the second driven pin portion 346 of the driven member 34 is in contact with the second push surface 235 of the push member 23, so that the auxiliary urge portion 292 of the auxiliary push member 29 is retracted into the slide cover 31 (i.e., the auxiliary urge portion 292 is removed from the path of movement of the urge unit 28) and the drawer is closed. At this time, the movable rail unit 12 is in an energy-stored state. Since the latch pin portion 333 of the latch member 33 engages the positioning portion 531, at this time, the first driven pin portion 344 of the driven member 34 is at the energy-storing end point (Y), is not subjected to any external force, and is freely retained in the bent groove 62. The distance of the abovementioned movement of the slide cover 31 to move the latch pin portion 333 of the latch member 33 relative to the slide cover 31 from the transition groove 55 to the positioning portion 531 is about a few millimeters. It should be noted that, after the driven projection 343 of the driven member 34 is removed from the path of movement of the first push surface 233 of the push member 23, the first-stage restoring force generated by the force-creating mechanism 4 would not act on the first push surface 233 of the push member 23 to push the drawer in the energy-release direction 92, so the urge unit 28 in this disclosure does not need to be constrained by an additional constraint member. In a modification of the embodiment, the transition groove 55 may be omitted, and the latch pin portion 333 of the latch member 33 can directly move along the energy-storing groove 51 into the positioning portion 531 by modifying the configuration of the energy-storing groove 51.

Referring to FIGS. 10 and 11, when the slide cover 31 moves the latch pin portion 333 of the latch member 33 relative to the slide cover 31 from the transition groove 55 to the positioning portion 531 (driven by the first-stage restoring force), the swing pin portion 372 of the swing arm 37 moves along the second passage 325 of the buffer passage unit 323 and pushes one of the teeth 361 of the first buffer member 36 to rotate the first buffer member 36, so that the first buffer member 36 generates a damping force to damp the abovementioned movement of the slide cover 31. As such, the latch pin portion 333 of the latch member 33 is prevented from violently colliding with the slide cover 31, extending the service lives of the components of the self-opening device. In some embodiment, the first buffer member 36 may be applied with damping oil to generate a relatively greater damping force during its rotation.

The self-opening device according to the disclosure provides two manners in which the drawer is opened. The first one is to directly draw the drawer forwardly in the energy-release direction 92, and the second one is to depress the drawer rearwardly in the energy-storing direction 91 so that the drawer can be opened by the restoring force generated by the springs 41 of the force-creating mechanism 4.

Figure 12:
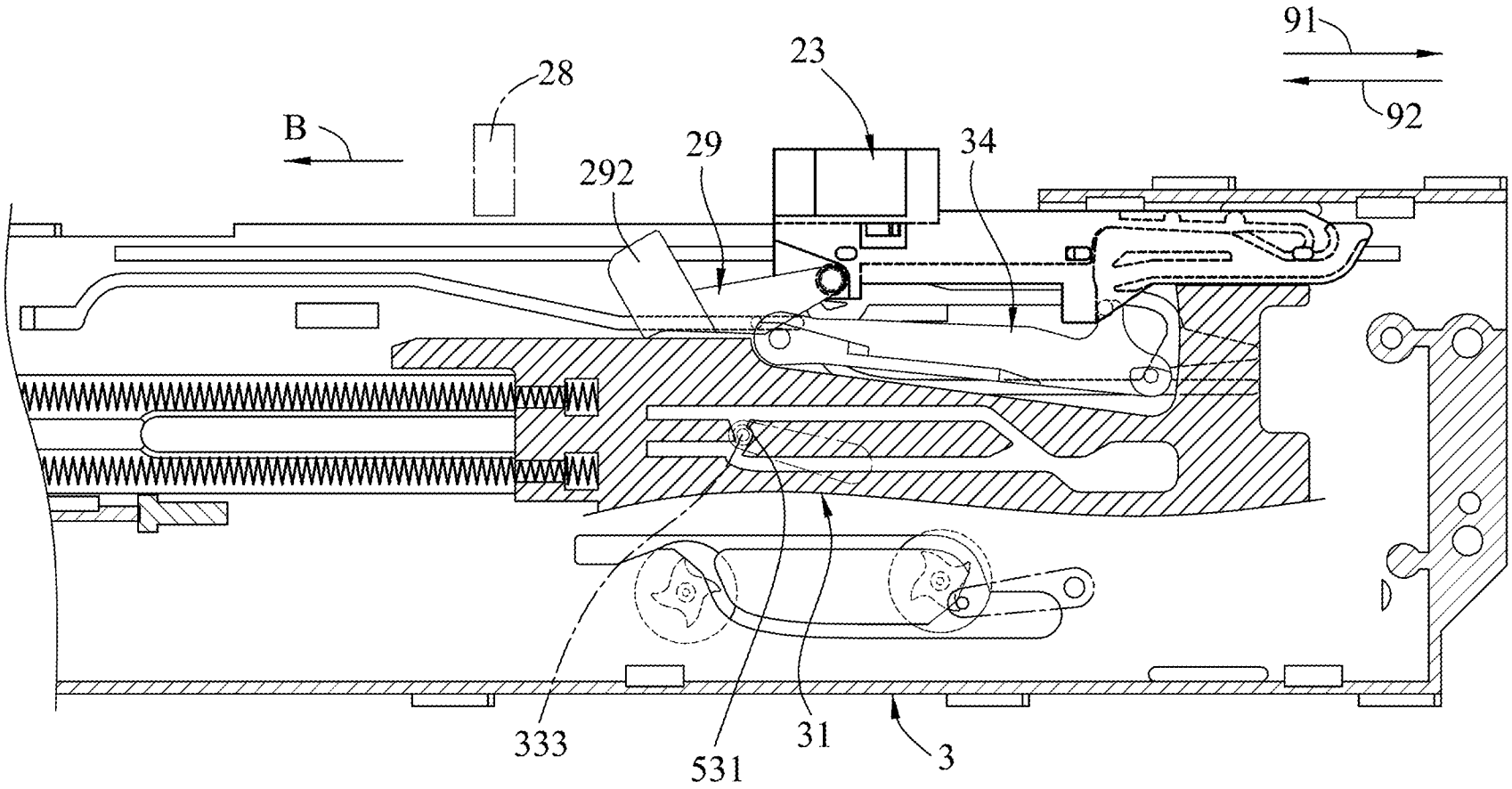
FIG. 12 is a fragmentary sectional view illustrating an urge unit being drawn to move in an energy-release direction.

Referring to FIGS. 11 and 12, to open the drawer in the first manner, an external force is applied to move the drawer forwardly in the energy-release direction 92 (i.e., the arrow (B) in FIG. 12), so that the movable rail unit 12 (see FIG. 2) and the urge unit 28 are moved in the energy-release direction 92. Since the auxiliary urge portion 292 is removed from the path of movement of the urge unit 28, during such opening operation, the urge unit 28 freely moves in the energy-release direction 92 without forcibly passing any component until the drawer is fully opened, the slide cover 31 is maintained at the energy-stored position, and the push member 23 is not moved. To close the drawer again, the drawer is pushed to move in the energy-storing direction 91 while the slide cover 31 is maintained at the energy-stored position.

Figure 13:
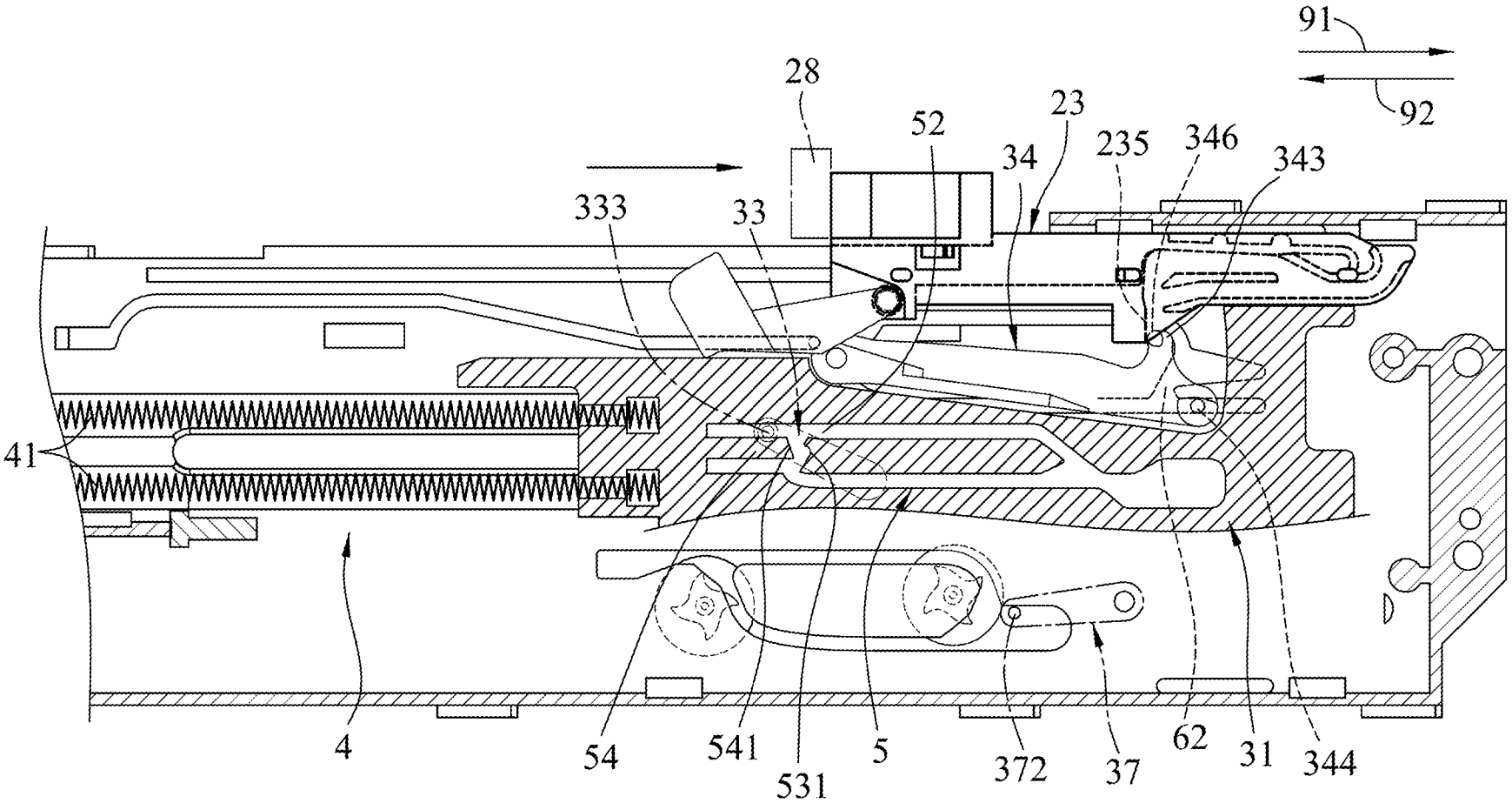
FIG. 13 is a fragmentary sectional view illustrating the latch pin portion of a latch member at an energy-release initial point of a latch groove unit.

Referring to FIGS. 11 and 13, to open the drawer in the second manner, an external force is applied to depress the drawer rearwardly in the energy-storing direction 91, so that the urge unit 28 pushes and moves the push member 23 in the energy-storing direction 91. The second push surface 235 of the push member 23 therefore pushes the second driven pin portion 346 of the driven member 34 to move the driven member 34 and the slide cover 31 in the energy storing direction 91, so that the latch pin portion 333 of the latch member 33 is disengaged from the positioning portion 531 and is guided by the second transition surface 541 of the second transition block 54 to move to an energy-release initial point of the energy-release groove 52 of the latch groove unit 5 (see FIG. 13), and that the slide cover 31 moves away from the energy-stored position. The springs 41 of the force-creating mechanism 4 is further stretched to generate the second-stage restoring force after the abovementioned operation.

Figure 14:
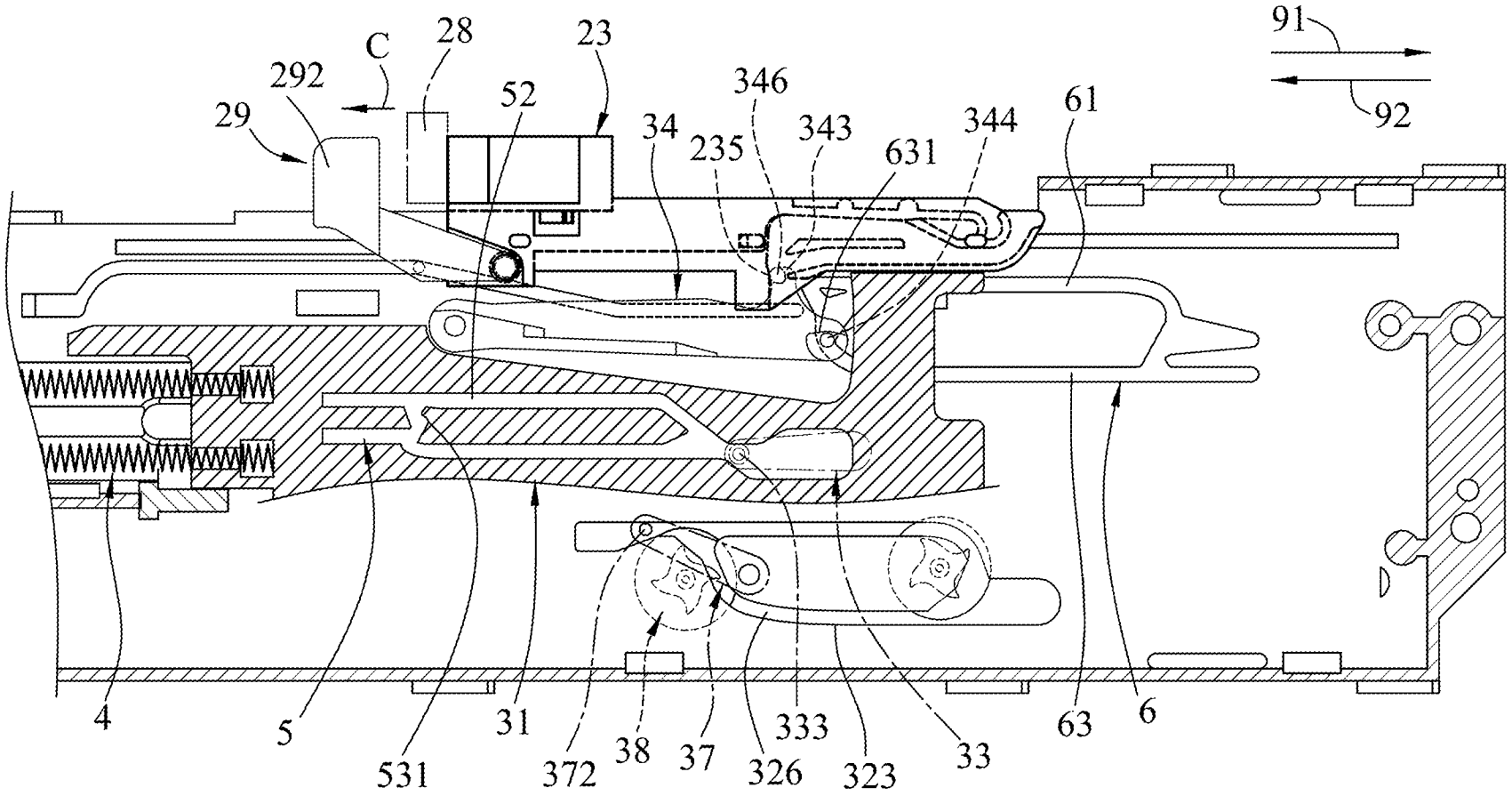
FIG. 14 is a fragmentary sectional view illustrating the first driven pin portion of the driven member at a stagnation region of the driven groove unit.
Figure 15:
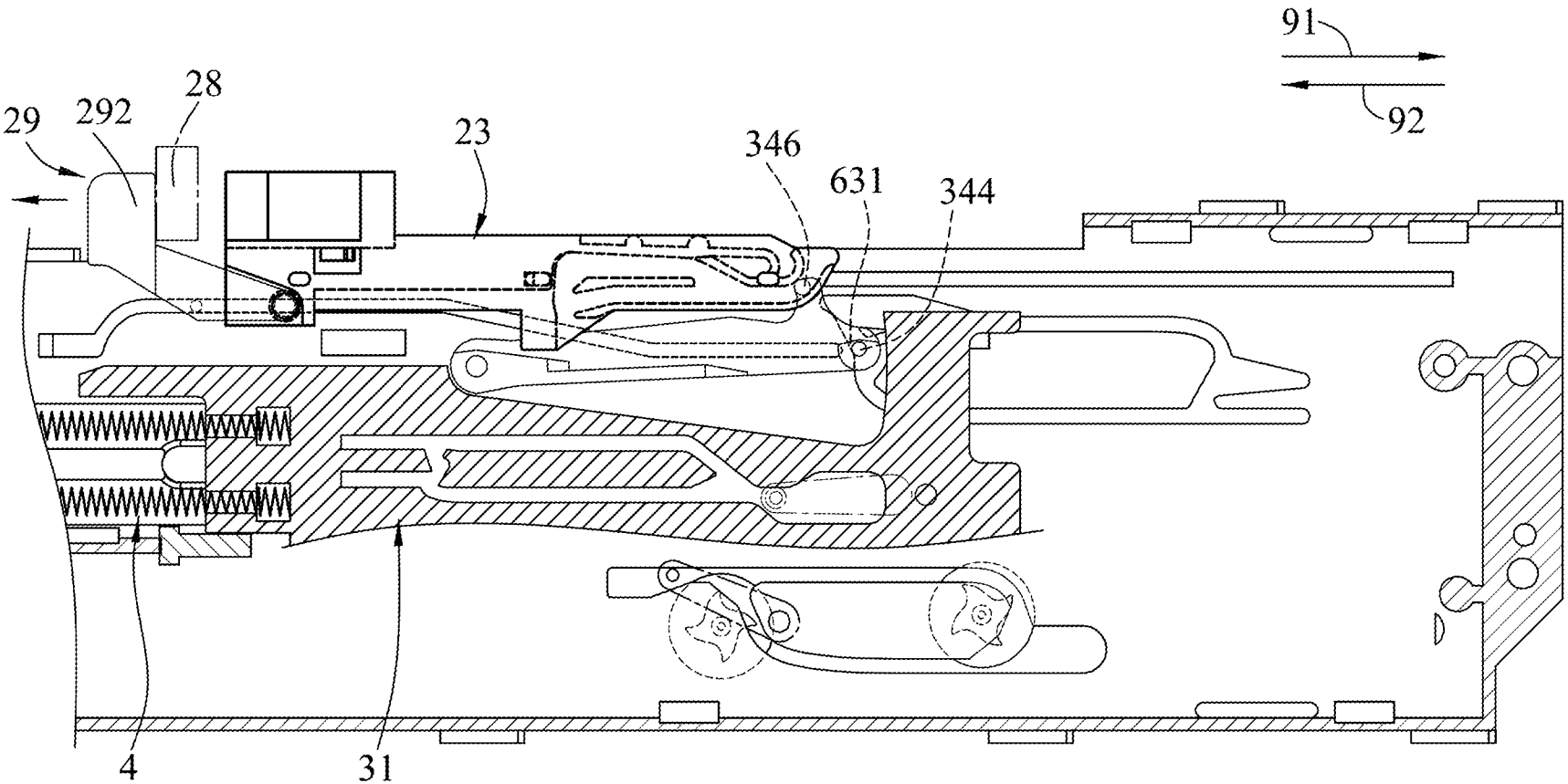
FIG. 15 is a fragmentary sectional view illustrating the first driven pin portion of the driven member being driven to move past the stagnation region of the driven groove unit.

Referring to FIGS. 14 to 16, when the external force in the energy-storing direction 91 is removed, the second-stage restoring force generated by the force-creating mechanism 4 draws the slide cover 31 to move in the energy-release direction 92 so that the latch pin portion 333 of the latch member 33 moves along the energy-release groove 52 of the latch groove unit 5. During the movement of the slide cover 31 back to the energy-storing initial position shown in FIG. 16 (with reference to FIGS. 6 and 8), the driven projection 343 of the driven member 34 pushes the second push surface 235 of the push member 23 so that the push member 23 pushes and moves the urge unit 28 in the energy-release direction 92, and the first driven pin portion 344 of the driven member 34 moves back to the energy-storing initial point (X) at the energy-storing groove 61 of the driven groove unit 6 via the energy-release groove 63.

In more detail, in the state shown in FIG. 14, the auxiliary urge portion 292 of the auxiliary push member 29 moves back onto the path of movement of the urge unit 28 again, and the first driven pin portion 344 of the driven member 34 is at the stagnation region 631 of the energy-release groove 63 of the driven groove unit 6. The stagnation region 631 is configured to temporarily stagnate the movement of the first driven pin portion 344 of the driven member 34, so that the slide cover 31 is temporarily unable to be moved by the force-creating mechanism 4, and the slide cover 31, the push member 23 and the auxiliary push member 29 are temporarily stationary. The urge unit 28 has the tendency to move in the energy-release direction 92 (as shown by the arrow (C) in FIG. 14), so as to hit and move the auxiliary urge portion 292 of the auxiliary push member 29 in the energy-release direction 92. Referring to FIG. 15, the auxiliary push member 29 drives the push member 23 to move in the energy-release direction 92, and the second driven pin portion 346 of the driven member 34 is guide by the guide groove 237 (see FIG. 4) of the push member 23 to rotate the driven member 34 such that the first driven pin portion 344 of the driven member 34 moves past the stagnation region 631 of the driven groove unit 6. Referring to FIG. 16, therefore, the slide cover 31 is moved by the force-creating mechanism 4 again back to the energy-storing initial position, the latch pin portion 333 of the latch member 33 moves back to the energy-storing initial point of the energy-storing groove 51 of the latch groove unit 5, the first driven pin portion 344 of the driven member 34 moves back to the energy-storing initial point (X) of the driven groove unit 6, and the auxiliary urge portion 292 of the auxiliary push member 29 is retracted into the slide cover 31. The urge unit 28 can freely move past the auxiliary push member 29 for fully opening the drawer. The swing pin portion 372 of the swing arm 37 moves back to the initial point of the first passage 324 of the buffer passage unit 323 via the third passage 326. The following close operation of the drawer is the same as the above.

Figure 17:
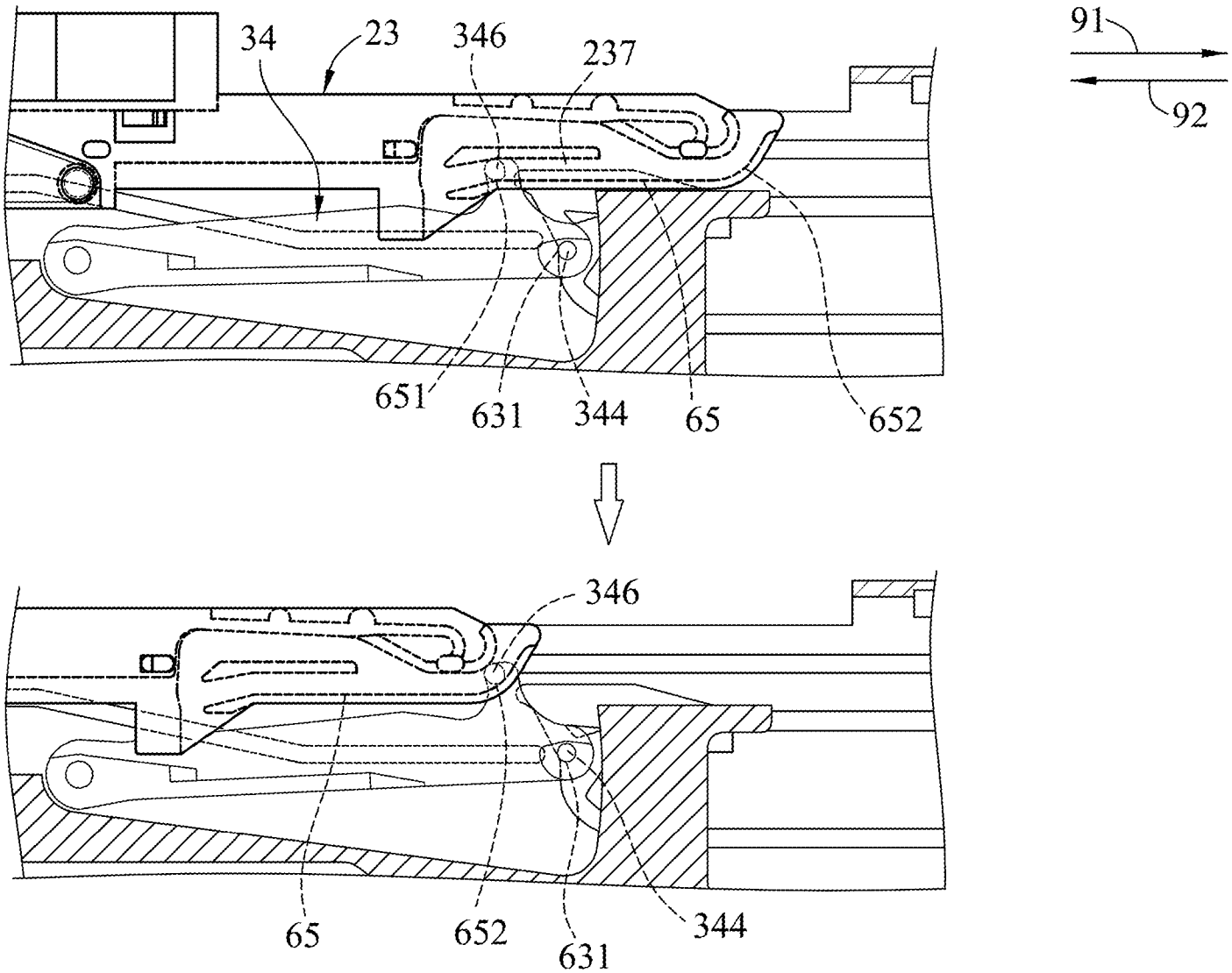
FIG. 17 illustrates the movement of the first driven pin portion of the driven member from FIG. 14 to FIG. 15.

FIG. 17 illustrating the movement of the first driven pin portion 344 and the second driven pin portion 346 of the driven member 34 in the process from FIG. 14 to FIG. 15. The push member 23 further has a guide surface 65 that partially defines the guide groove 237 and that has a first guide region 651 and a second guide region 652. The first driven pin portion 344 of the driven member 34 is temporarily retained at the stagnation region 631 of the driven groove unit 6 (see FIG. 14). When the urge unit 28 hits the auxiliary urge portion 292 of the auxiliary push member 29 to move the auxiliary push member 29 and the push member 23 in the energy-release direction 92, the second driven pin portion 346 of the driven member 34 is guided by the first guide region 651 of the guide surface 65 so that the first driven pin portion 344 of the driven member 34 almost moves past the stagnation region 631 (see the upper portion of FIG. 17). With further movement of the push member 23 in the energy-release direction 92, the second driven pin portion 346 of the driven member 34 is guided by the second guide region 652 of the guide surface 65 so that the first driven pin portion 344 of the driven member 34 moves past the stagnation region 631 (see the lower portion of FIG. 17), and then moves to the position shown in FIG. 16. In summary, to open the drawer in the second manner, the first driven pin portion 344 of the driven member 34 first moves to the stagnation region 631 by the second-stage restoring force generated by the force-creating mechanism 4, and then moves back to the energy-storing initial point (X) of the driven groove unit 6 by the auxiliary push member 29 and the push member 23.

Figure 18:
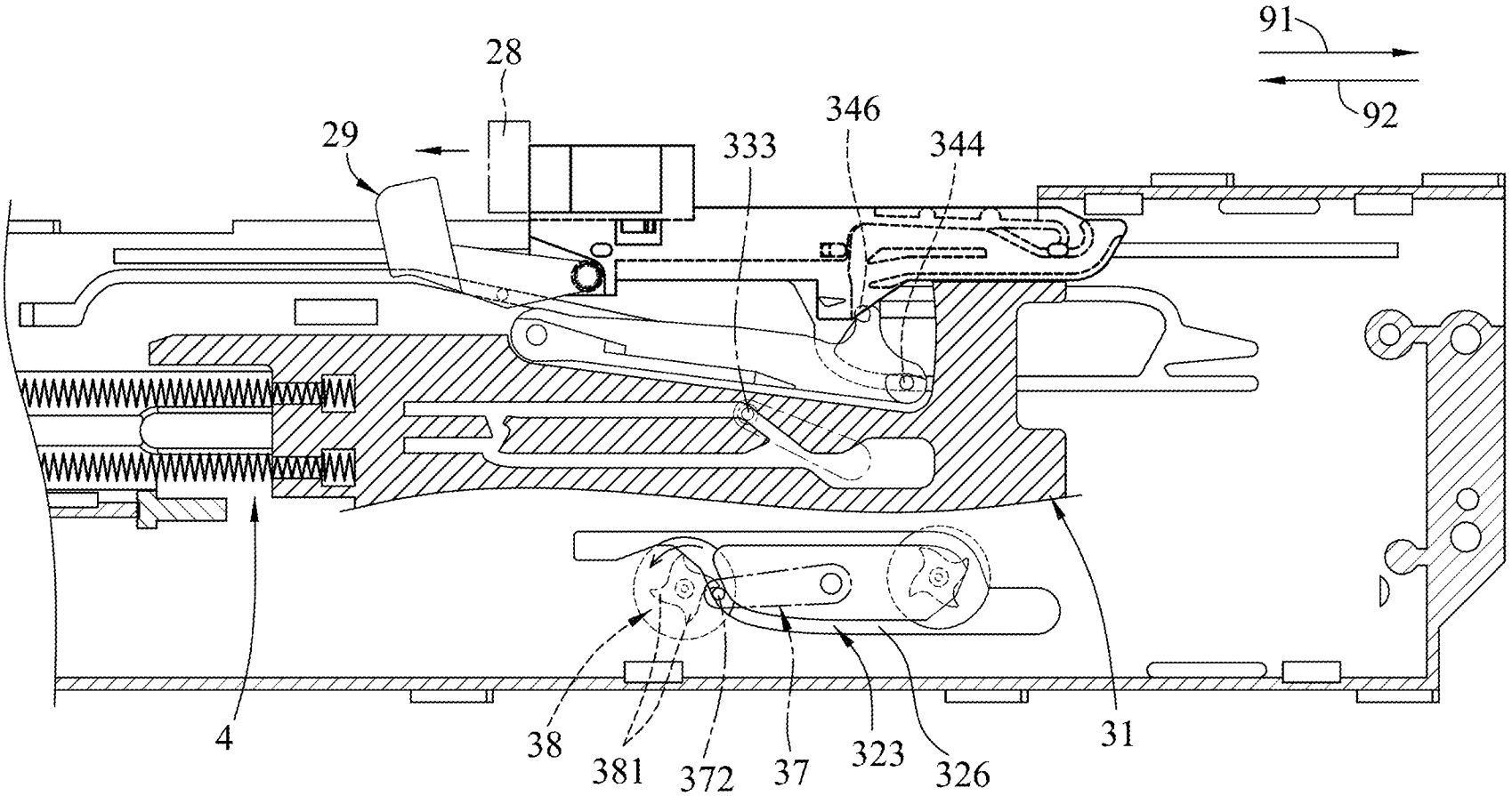
FIG. 18 is a fragmentary sectional view illustrating a state between FIG. 13 and FIG. 14.

FIG. 18 illustrates the movement of the swing pin portion 372 of the swing arm 37 in the process from FIG. 13 to FIG. 14. When the second-stage restoring force generated by the force-creating mechanism 4 draws the slide cover 31 to move in the energy-release direction 92 upon removal of the external force in the energy-storing direction 91, the swing pin portion 372 of the swing arm 37 moves along the third passage 326 of the buffer passage unit 323 and pushes one of the teeth 381 of the second buffer member 38 to rotate the second buffer member 38, so that the second buffer member 38 generates a damping force to damp the abovementioned movement of the slide cover 31. As such, the first driven pin portion 344 of the driven member 34 is prevented from violently colliding with the base seat 32 when the first driven pin portion 344 moves to the stagnation region 631, and the urge unit 28 moves at a relatively low speed to hit the auxiliary push member 29, prolonging the service lives of the components of the self-opening device. In some embodiment, the second buffer member 38 may be applied with damping oil to generate a relatively greater damping force during its rotation.

It should be noted that, the concept in this disclosure is to store energy by relative movement between two objects, and to drive relative movement between two objects by releasing the stored energy. In practice, either of the two objects need not be limited to be fixed, and the two objects are not limited to move toward each other or move away from each other.

In summary, since the push mechanism 2 is operable to push the driven projection 343 so as to move the driven member 34 in the energy-storing direction 91, since the first driven pin portion 344 of the driven member 34 is movable within the driven groove unit 6, and since the latch pin portion 333 of the latch member 33 is movable within the latch groove unit 5, the slide cover 31 is smoothly movable relative to the base seat 32 in the energy-storing direction 91 and the energy-release direction 92. The swing arm 37 cooperates with the first buffer member 36 to damp the movement of the slide cover 31 driven by the first-stage restoring force generated by the force-creating mechanism 4, so as to prevent the latch pin portion 333 of the latch member 33 from violently colliding with the slide cover 31, and to alleviate the friction between the first driven pin portion 344 of the driven member 34 and the block member 64 when the first driven pin portion 344 moves from the energy-storing groove 61 into the bent groove 62. The swing arm 37 further cooperates with the second buffer member 38 to damp the movement of the slide cover 31 driven by the second-stage restoring force generated by the force-creating mechanism 4, so as to prevent the first driven pin portion 344 of the driven member 34 from violently colliding with the base seat 32 when the first driven pin portion 344 moves to the moves to the stagnation region 631 of the driven groove unit 6. The auxiliary push member 29 is driven to move the first driven pin portion 344 of the driven member 34 away form the stagnation region 631, to the self-opening device of this disclosure can be used in any article that is movable along a rail. Moreover, since the self-opening device of this disclosure is not provided with a locking structure that automatically locks the drawer relative to the housing when the drawer is closed, the drawer can be easily and directly drawn from the housing without being pushed in the energy-storing direction 91. When the drawer is opened in the first manner, since the auxiliary push member 29 has been removed from the path of movement of the urge unit 28, the push member 23 can freely move past the auxiliary push member 29 without contacting the auxiliary push member 29 so as to prevent fracture of the components.

Referring to FIG. 11, it should be noted that after the slide cover 31 moves to the energy-stored position (see FIG. 11), the first push surface 233 of the push member 23 is separated from the driven projection 343 of the driven member 34 so that the push member 23 would not be biased by the force-creating mechanism 4. After the drawer is closed, the auxiliary push member 29 is removed from the path of movement of the urge unit 28, so that a user can directly draw the drawer out of the housing without forcing the urge unit 28 to move past any component. Referring back to FIG. 1, the locking member 10 of the conventional self-opening device is in contact with the movable member 14, and is located on the path of movement of the movable member 14 to prevent the movement of the movable member 14. Therefore, the function of the auxiliary push member 29 of this disclosure is completely different from the locking member 10 of the conventional self-opening device.

Figure 19:
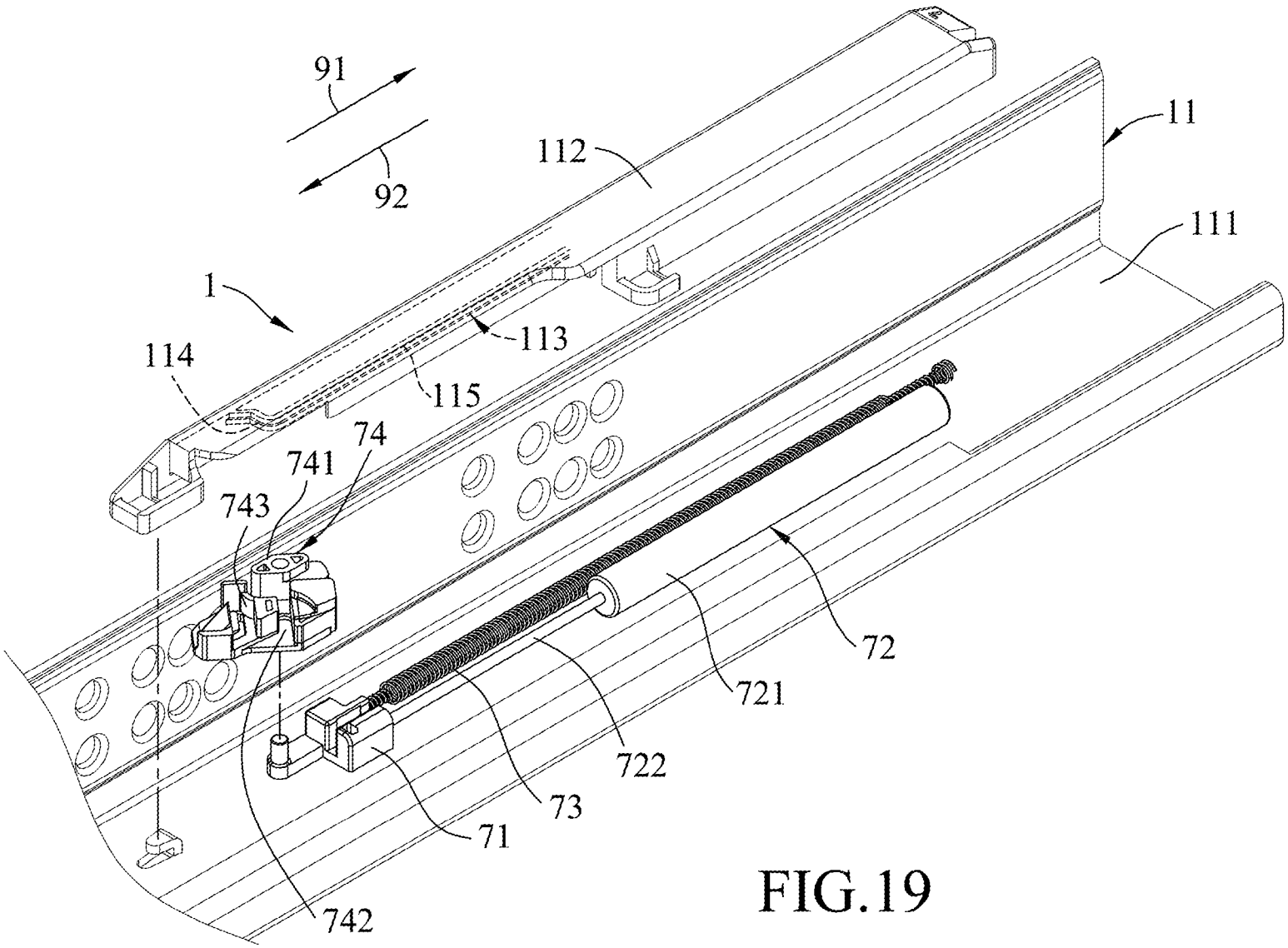
FIG. 19 is a fragmentary exploded perspective view illustrating a portion of a second embodiment of the self-opening device according to the disclosure.
Figure 20:
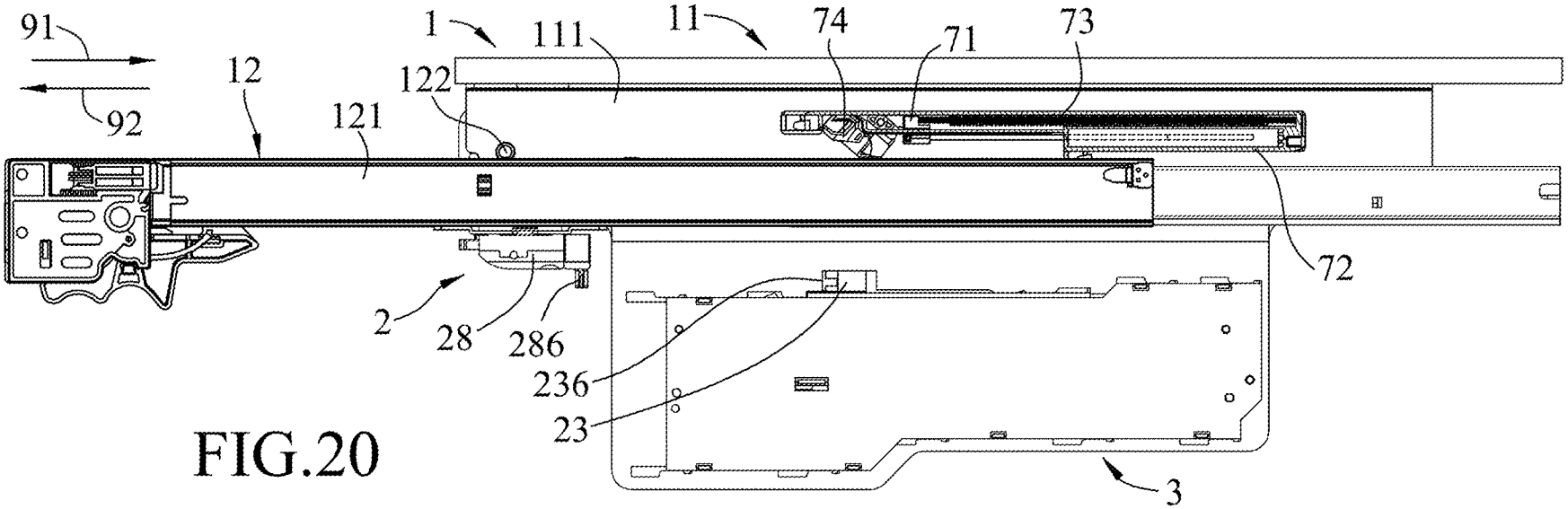
FIG. 20 is a top view illustrating a lock member being spaced apart from a pivot member of the second embodiment.
Figure 21:
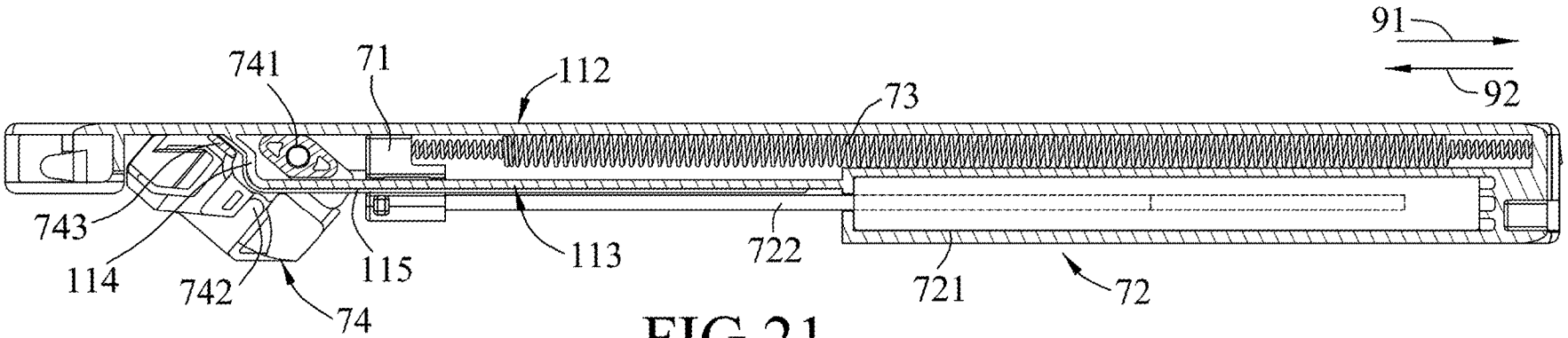
FIG. 21 is an enlarged sectional view illustrating the second embodiment in the state of FIG. 20.

Referring to FIGS. 19, 20 and 21, the second embodiment of the self-opening device according to the disclosure is similar to the first embodiment. The fixed rail unit 11 includes a fixed rail 111, and a cover member 112 that covers an upper portion of the fixed rail 111. The cover member 112 has a guide wall 113 formed at a bottom portion thereof. The guide wall 113 has a first wall portion 114 and a second wall portion 115 that is connected to the first wall portion 114 and that extends in the energy-storing direction 91. The movable rail unit 12 includes a movable rail 121, and a lock member 122 (see FIG. 20) that is co-movably mounted to the movable rail 121.

The second embodiment of the self-opening device further includes a movable member 71, a hydraulic cylinder 72, a return spring 73 and a pivot member 74. The movable member 71 is located above the fixed rail 111, is connected to the hydraulic cylinder 72, and is able to be driven to move in the energy-release direction 92 or in the energy-storing direction 91. The hydraulic cylinder 72 includes a cylinder body 721 that is fixedly disposed on the fixed rail 111, and a telescopic rod 722 that is telescopically mounted to the cylinder body 721 and that is connected to the movable member 71. The return spring 73 has an end connected to the movable member 71, and an opposite end connected to the fixed rail 111. The pivot member 74 is located above the fixed rail 111 and below the cover member 112. The pivot member 74 has a pivoted portion 741 that is pivotally connected to the movable member 71, an engaging portion 742 that is able to be engaged with the lock member 122, and a guide portion 743 that extends upwardly and that is able to be guided by the guide wall 113 to move along the guide wall 113.

Figure 22:
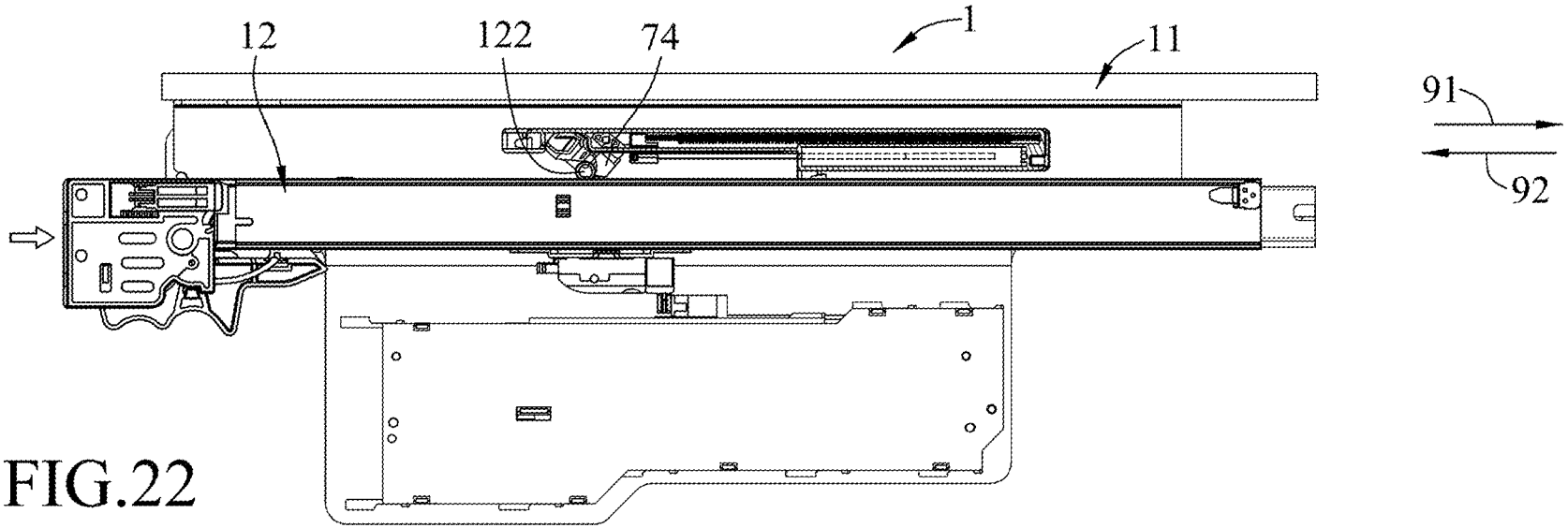
FIG. 22 is a top view illustrating the lock member engaging the pivot member.
Figure 23:
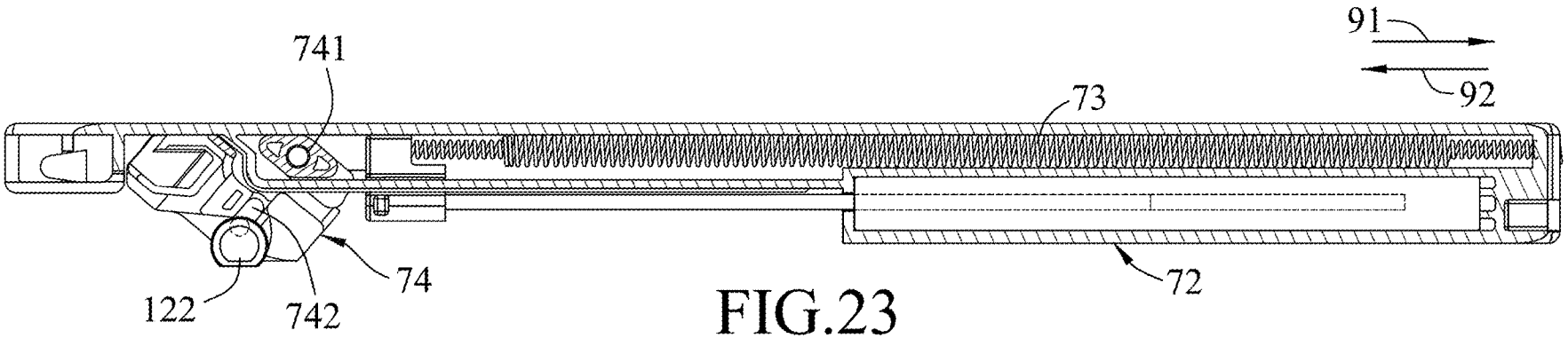
FIG. 23 is an enlarged sectional view illustrating the second embodiment in the state of FIG. 22.
Figure 24:
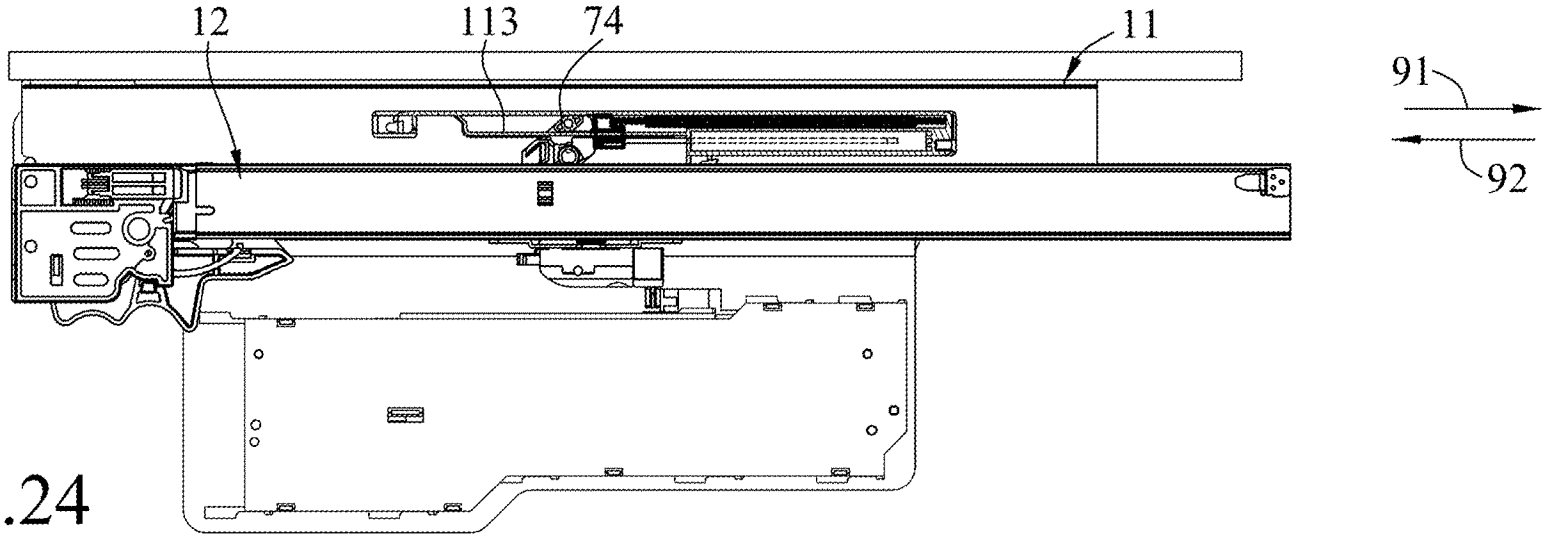
FIG. 24 is a top view illustrating the lock member pushing and rotating the pivot member.
Figure 25:
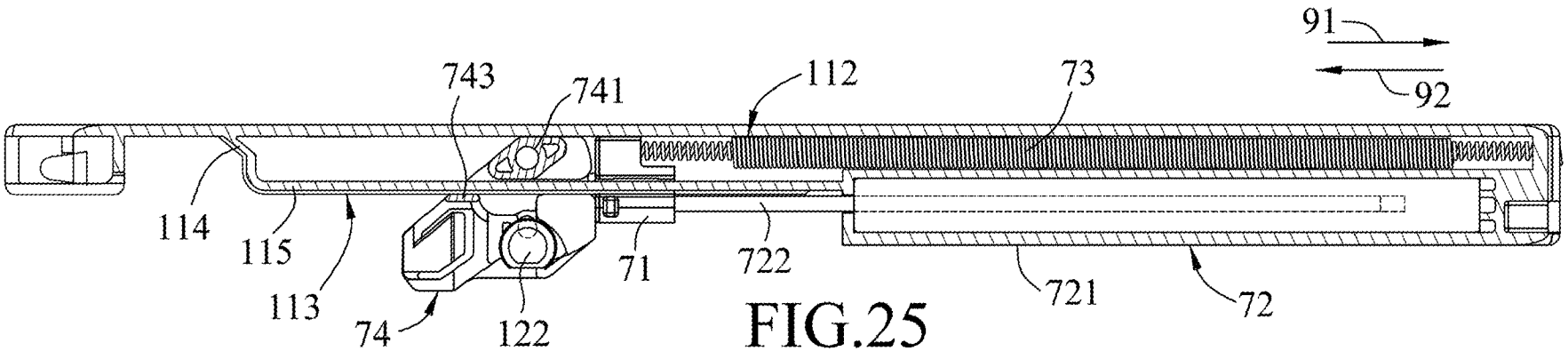
FIG. 25 is an enlarged sectional view illustrating the second embodiment in the state of FIG. 24.

Referring to FIGS. 20 and 21, when the drawer (not shown) is opened, the lock member 122 of the movable rail unit 12 is distal from the pivot member 74, the return spring 73 is stretched to restoring energy, and the guide portion 743 of the pivot member 74 is located beside the first wall portion 114 of the guide wall 133 of the cover member 112 so that the pivot member 74 is positioned. Referring to FIGS. 22 and 23, when the drawer is operated to close, the movable rail unit 12 is moved in the energy-storing direction 91 so that the lock member 122 approaches the pivot member 74 and engages the engaging portion 742 of the pivot member 74. Referring to FIGS. 24 and 25, with further movement of the movable rail unit 12 in the energy-storing direction 91, the lock member 122 pushes the pivot member 74 so that the pivot member 74 rotates counterclockwise about the pivoted portion 741 to the position shown in FIG. 25, and the pivot member 74 is pushed to move in the energy-storing direction 91. Since the guide portion 743 of the pivot member 74 moves along the guide wall 113 of the cover member 12, the movement of the pivot member 74 is limited by the guide wall 113. When the pivot member 74 moves in the energy-storing direction 91, the guide portion 743 moves along the second wall portion 115 of the guide wall 113, the movable member 71 is driven by the pivot member 74 to move in the energy-storing direction 91, the telescopic rod 722 is gradually retracted into the cylinder body 721, and the return spring 73 restores to its original state to release energy until the drawer is closed.

Figure 26:
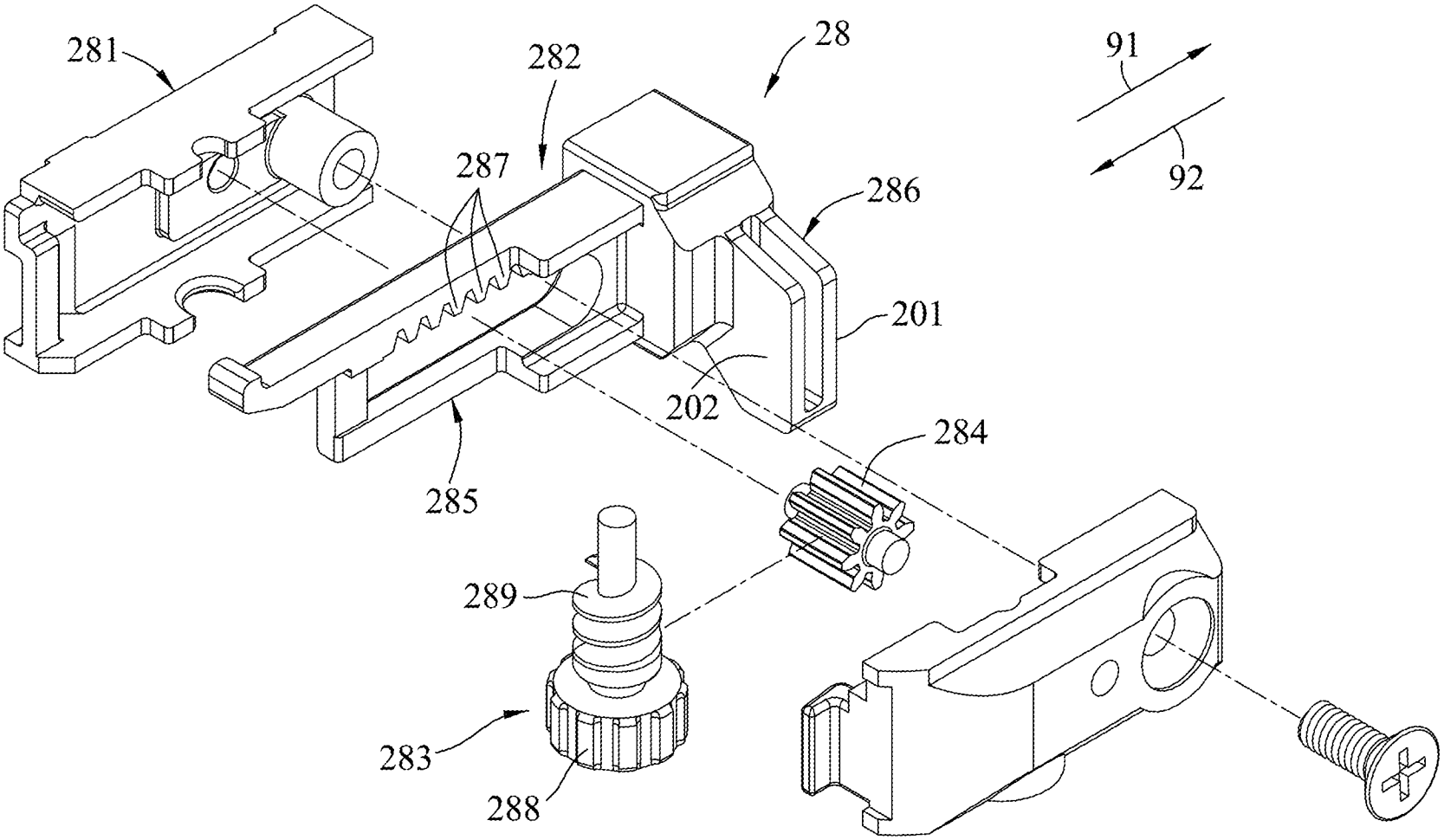
FIG. 26 is an exploded perspective view illustrating an urge unit of the first and second embodiments.

Referring to FIGS. 2, 20 and 26, the urge unit 28 of the first embodiment is the same to that of the second embodiment.

The urge unit 28 is disposed on the movable rail unit 12, and includes a casing 281, a push seat 282 movably mounted to the casing 281, an adjusting rod member 283 for adjusting the push seat 282, and a transmission gear 284 that meshes with the adjusting rod member 283 and the push seat 282. The casing 281 is fixedly connected to the movable rail unit 12, and is formed by two interconnected casing parts. It should be noted that the configuration of the casing 281 is not limited to such. The push seat 282 has an adjusting segment 285 that movably extends into the casing 281, and a seat segment 286 that is connected to an end of the adjusting segment 285 and that is disposed out of the casing 281 for pushing the push member 23. The adjusting segment 285 has a plurality of toothed portions 287 that project downwardly and that are arranged in the energy-storing direction 91.

The adjusting rod member 283 is rotatably mounted to the casing 281, and has an adjusting portion 288 that is disposed below the casing 281, and a threaded rod portion 289 that extends upwardly from the adjusting portion 288 and into the casing 281 and that meshes with the transmission gear 284. In some embodiment, the threaded rod portion 289 of the adjusting rod member 283 and the transmission gear 284 are configured as worm and worm gear. The adjusting portion 288 can be rotated to move the push seat 282 relative to the casing 281 in the energy-storing direction 91 or the energy-release direction 92 via the meshing of the threaded rod portion 289 and the transmission gear 284. The function of the design of the urge unit 28 is: when the drawer is closed, a front panel of the drawer can be adjusted to be flushed with the housing or other drawers.

Referring to FIGS. 11 and 26, it should be noted that the seat segment 286 of the seat member 282 has a first surface 201 that faces in the energy-storing direction 91 for contact with the urge surface 236 of the push member 23, and a second surface 202 that is opposite to the first surface 201 and that faces in the energy-release direction 92. When the latch pin portion 333 of the latch member 33 engages the positioning portion 531 of the latch groove unit 5 and when the drawer is closed (i.e., the first surface 201 is in contact with the urge surface 236 of the push member 23), a portion of the path of movement of the urge unit 28 that extends from the second surface 202 of the seat segment 286 of the seat member 282 in the energy-release direction 92 is unblocked (i.e., there is no component located on the portion of the path of movement of the urge unit 28), so that the drawer can be directly drawn out of the housing in the energy-release direction 92 without forcing any two of the components to move past each other.

Figure 27:
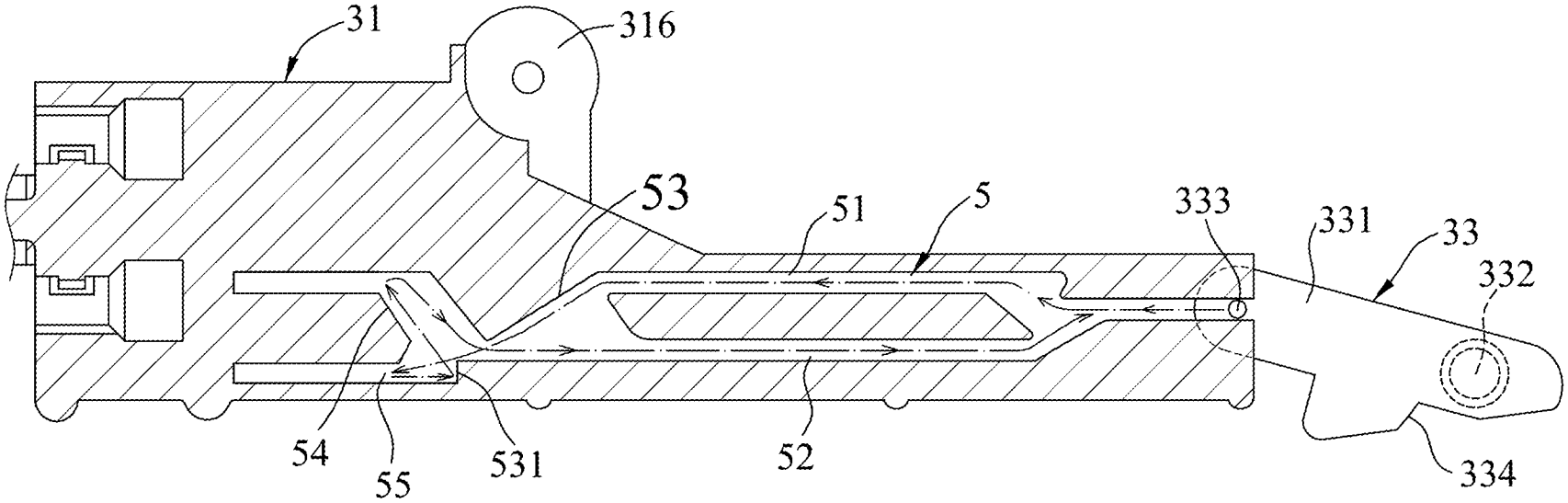
FIG. 27 is a sectional view illustrating a slide cover and a latch member of a third embodiment of the self-opening device according to the disclosure.
Figure 28:
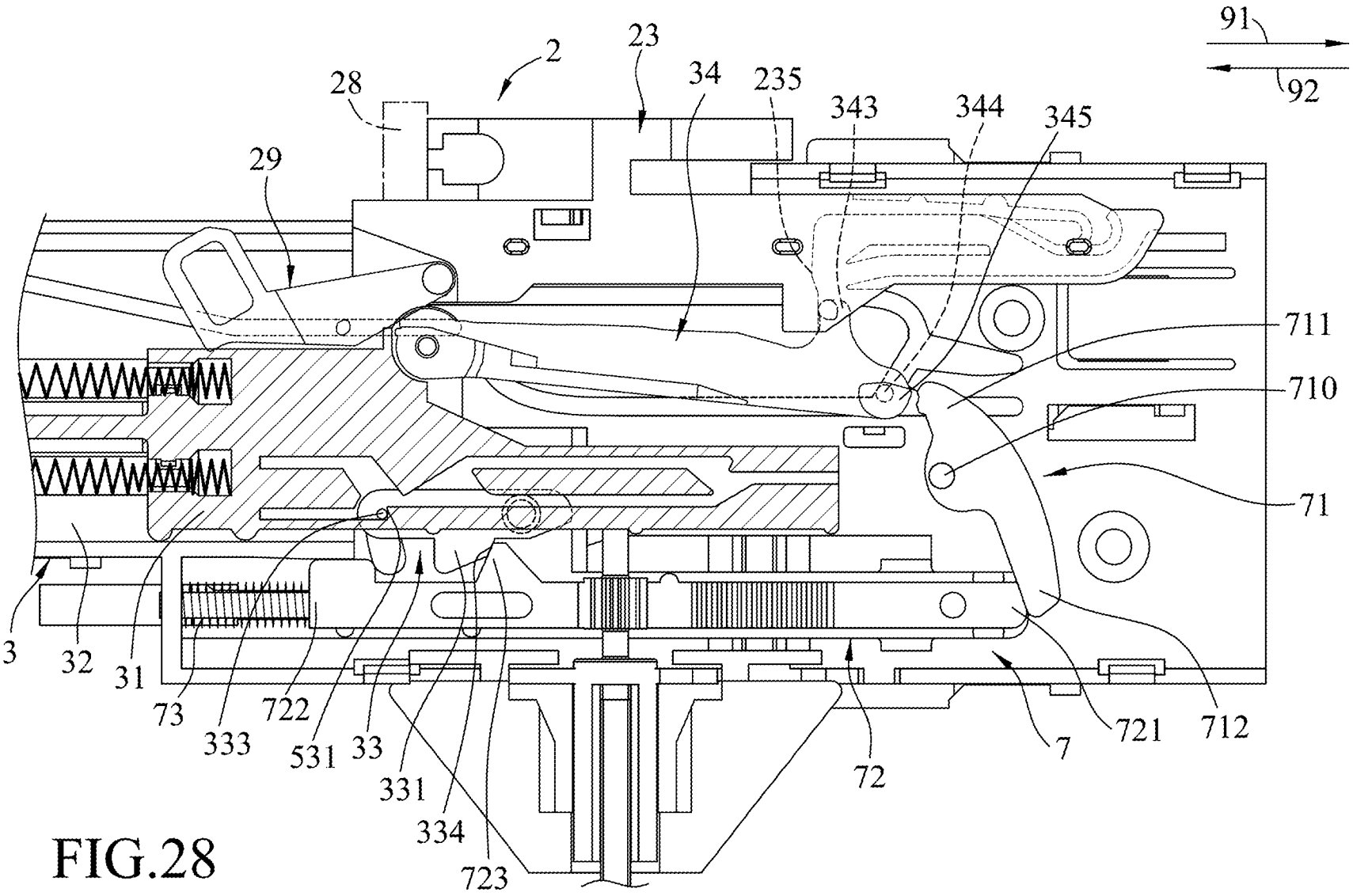
FIG. 28 is a fragmentary sectional view illustrating a state of the third embodiment.

Referring to FIGS. 27 and 28, the third embodiment of the self-opening device according to the disclosure is similar to the first embodiment. The energy-storing groove 51, the energy-release groove 52, the positioning portion 531, a first transition block 53, the second transition block 54 and the transition groove 55 of the latch groove unit 5 are configured to be slightly different from those of the first embodiment. The positioning portion 531 is aligned with the transition groove 55 in the energy-release direction 92. The path of movement of the latch pin portion 333 of the latch member 33 within the latch groove unit 5 is shown by the dash-dot broken line in FIG. 27.

In the third embodiment, the latch member 33 is further formed with a pushed surface 334, and the driven member 34 further has a pushing portion 345 that is adjacent to the first driven pin portion 344.

The third embodiment further includes a transmission mechanism 7. The transmission mechanism 7 includes a first transmission member 71, a second transmission member 72 and a transmission resilient member 73. The first transmission member 71 is pivotably mounted to the base seat 32, and has a first pivoted portion 710 that is pivoted to the base seat 32, a pushed portion 711 and a pushing portion 712 that are respectively located at two opposite sides of the first pivoted portion 710. The second transmission member 72 is elongated, extends in the energy-storing direction 91, and has a first end portion 721 that is proximate to the pushing portion 712 of the first transmission member 71, a second end portion 722 that is opposite to the first end portion 721, and an urging portion 723 that is located between the first end portion 721 and the second end portion 722 and that protrude toward the latch member 33. The urging portion 723 of the second transmission member 72 is for pushing the pushed surface 334 of the latch member 33. The transmission resilient member 73 is disposed between a wall section of the base seat 32 and the second end portion 722 of the second transmission member 72, and resiliently biases the second transmission member 72 in the energy-storing direction 91.

Figure 29:
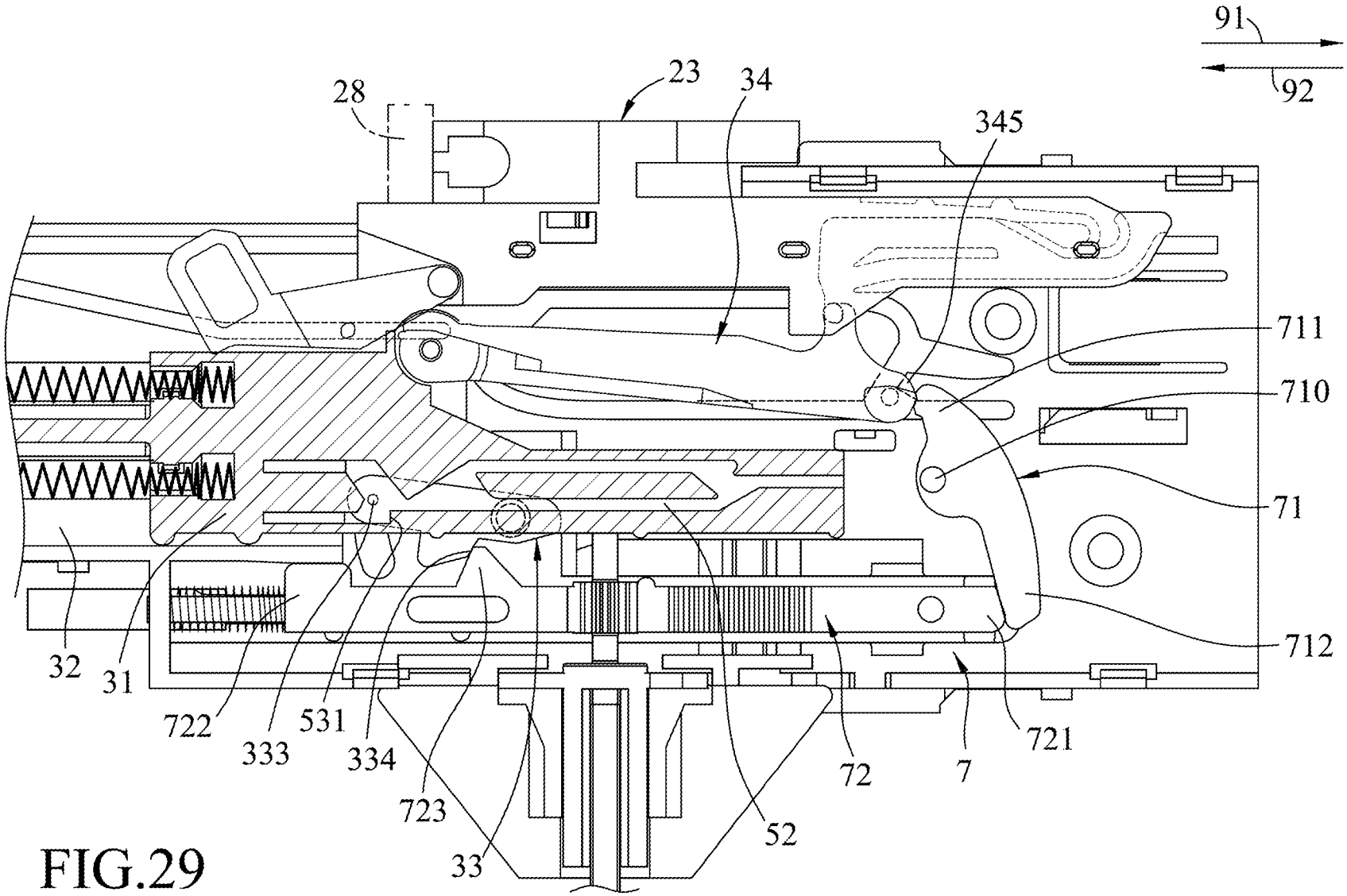
FIG. 29 is another fragmentary sectional view illustrating another state of the third embodiment.

Referring to FIGS. 28 and 29, when the drawer is opened in the second manner (by depressing the drawer in the energy-storing direction 91) after the latch pin portion 333 of the latch member 33 engages the positioning portion 531 to position the slide cover 31 at the energy-stored position, the slide cover 31 is moved relative to the base seat 32 in the energy-storing direction 91 so that the latch pin portion 333 of the latch member 33 is separated from the positioning portion 531. During the abovementioned movement, the pushing portion 345 of the driven member 34 moves in the energy-storing direction 91 to push the pushed portion 711 of the first transmission member 71 so as to rotate the first transmission member 71 clockwise, and then the pushing portion 712 of the first transmission member 71 pushes the first end portion 721 of the second transmission member 72 to move the second transmission member 72 in the energy-release direction 92 against the biasing action of the transmission resilient member 73, so that the urging portion 723 of the second transmission member 72 pushes the pushed surface 334 of the latch member 33 to rotate the latch member 33 clockwise. As such, the latch pin portion 333 of the latch member 33 moves toward the second transition block 54 rather than toward the transition groove 55 that is aligned with the positioning portion 531.

By virtue of the transmission mechanism 7, after an external force that pushed the drawer rearwardly is removed, the latch pin portion 333 of the latch member 33 is permitted to move into the energy-release groove 52, so that the slide cover 31 is able to move back to the energy-storing initial position.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A self-opening device adapted for use in a slide rail mechanism, the slide rail mechanism including a fixed rail unit, and a movable rail unit that is movable along the fixed rail unit in an energy-storing direction and an energy-release direction different from the energy-storing direction, said self-opening device comprising:

a motion guide mechanism including a movable slide cover, a base seat, a latch member, a driven member and a driven groove unit, said slide cover including a latch groove unit, said latch groove unit including a positioning portion, said driven groove unit having an energy-storing groove and a bent groove, said latch member having a latch pin portion, said latch pin portion of said latch member being movable within said latch groove unit, said driven member comprising a first driven pin portion being movable along said driven groove unit, said first driven pin portion of said driven member and said latch pin portion of said latch member being movable relative to each other;

a force-creating mechanism being able to store elastic energy for providing a restoring force that is oriented in the energy-release direction to said slide cover; and a damper coupled to said base seat, wherein, said slide cover is associated with said force-creating mechanism, a movement of said slide cover drawn by said force-creating mechanism in the energy-release direction for engaging said positioning portion with said latch pin portion of said latch member and for moving said first driven pin portion of said driven member from said energy-storing groove into said bent groove being able to be damped by said damper.

2. The self-opening device as claimed in claim 1, wherein said driven groove unit further has an energy-release groove that extends from said bent groove in the energy-release direction, said first driven pin portion being movable along said energy-storing groove, said bent groove and said energy-release groove of said driven groove unit, said first driven pin portion being located in said bent groove when said latch pin portion engages said positioning portion.

3. The self-opening device as claimed in claim 2, further comprising a push mechanism, said push mechanism including an auxiliary push member, and an urge unit that is adapted to be co-movably mounted to the movable rail unit, said energy-release groove of said driven groove unit of said motion guide mechanism further including a stagnation region;

wherein, said auxiliary push member is removed from the path of movement of said urge unit when said latch pin portion engages said positioning portion; and wherein, when an external force in the energy-storing direction is applied on the movable rail unit to disengage said latch pin portion of said latch member from said positioning portion of said latch groove unit, the restoring force generated by said force-creating mechanism drives said first driven pin portion to move to said stagnation region, and said auxiliary push member subsequently draws said first driven pin portion to move to an energy-storing initial point.

4. The self-opening device as claimed in claim 2, wherein said driven member is pivotally mounted to said slide cover, said first driven pin portion of said driven member protruding downwardly, and movable along said energy-storing groove, said bent groove and said energy-release groove of said driven groove unit.

* * * * *